US006964842B2

(12) United States Patent
Zou et al.

(10) Patent No.: US 6,964,842 B2
(45) Date of Patent: Nov. 15, 2005

(54) BLACK-AND-WHITE AQUEOUS PHOTOTHERMOGRAPHIC MATERIALS

(75) Inventors: Chaofeng Zou, Maplewood, MN (US); Roger L. Klaus, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 63 days.

(21) Appl. No.: 10/641,206

(22) Filed: Aug. 14, 2003

(65) Prior Publication Data

US 2004/0033447 A1 Feb. 19, 2004

Related U.S. Application Data

(63) Continuation-in-part of application No. 10/193,443, filed on Jul. 11, 2002, now Pat. No. 6,713,240.

(51) Int. Cl.[7] ..... G03C 1/498; G03C 5/16; G03C 1/34

(52) U.S. Cl. ..... 430/350; 430/139; 430/510; 430/607; 430/611; 430/613; 430/614; 430/619; 430/620; 430/966

(58) Field of Search ..... 430/619, 611, 430/620, 567, 607, 613, 614, 640, 510, 139, 966, 350

(56) References Cited

U.S. PATENT DOCUMENTS

| | | | | | |
|---|---|---|---|---|---|
| 2,131,038 | A | | 9/1938 | Brooker et al. | |
| 2,694,716 | A | | 11/1954 | Allen et al. | |
| 3,832,186 | A | * | 8/1974 | Masuda et al. | 430/619 |
| 3,954,478 | A | | 5/1976 | Arai et al. | |
| 4,088,496 | A | | 5/1978 | Merkel | |
| 4,105,451 | A | | 8/1978 | Smith et al. | |
| 4,137,079 | A | | 1/1979 | Houle | |
| 4,168,980 | A | | 9/1979 | LaRossa | |
| 4,201,582 | A | | 5/1980 | White | |
| 4,220,709 | A | | 9/1980 | deMauriac | |
| 4,374,196 | A | | 2/1983 | Herz | |
| 4,423,140 | A | | 12/1983 | Herz | |
| 4,451,561 | A | | 5/1984 | Hirabayashi et al. | |
| 4,543,309 | A | | 9/1985 | Hirabayashi | |
| 4,578,348 | A | | 3/1986 | Freeman et al. | |
| 4,584,267 | A | | 4/1986 | Masukawa et al. | |
| 4,840,882 | A | | 6/1989 | Iwagaki et al. | |
| 4,885,233 | A | | 12/1989 | Messing | |
| 5,149,620 | A | | 9/1992 | Simpson et al. | |
| 5,158,866 | A | | 10/1992 | Simpson et al. | |
| 5,316,886 | A | | 5/1994 | Koide et al. | |
| 5,620,837 | A | * | 4/1997 | Kim et al. | 430/506 |
| 5,681,693 | A | | 10/1997 | Bertoldi et al. | |
| 5,698,380 | A | * | 12/1997 | Toya | 430/363 |
| 5,807,667 | A | * | 9/1998 | Chang | 430/600 |
| 6,001,543 | A | | 12/1999 | Asami et al. | |
| 6,114,106 | A | | 9/2000 | Fujiwara et al. | |
| 6,165,704 | A | | 12/2000 | Miyake et al. | |
| 6,165,706 | A | | 12/2000 | Fujiwara et al. | |
| 6,440,649 | B1 | * | 8/2002 | Simpson et al. | 430/351 |

FOREIGN PATENT DOCUMENTS

| | | | |
|---|---|---|---|
| GB | 1543266 | * | 3/1979 |
| JP | 59-193447 | * | 11/1984 |

* cited by examiner

*Primary Examiner*—Thorl Chea
(74) *Attorney, Agent, or Firm*—J. Lanny Tucker; Louis M. Leichter

(57) ABSTRACT

Aqueous-based photothermographic materials comprise a hydrophilic binder, preformed silver halides, an organic silver salt, a reducing agent composition, and one or more benzothiazolium, benzoselenazolium, or benzotellurazolium salts as antifoggants. These photothermographic materials can be used in combination with phosphor intensifying screens for radiographic imaging.

29 Claims, No Drawings

BLACK-AND-WHITE AQUEOUS PHOTOTHERMOGRAPHIC MATERIALS

CROSS-REFERENCE TO RELATED APPLICATION

The present application is a Continuation-in-part application of U.S. Ser. No. 10/193,443 filed Jul. 11, 2002 by Lynch, Zou, and Ulrich, now U.S. Pat. No. 6,713,240.

FIELD OF THE INVENTION

This invention relates to black-and-white aqueous-based photothermographic materials that comprise certain benzothiazolium, benzoselenazolium, or benzotellurazolium salts as antifoggants. The invention also relates to methods of imaging using these materials. This invention is directed to the photothermographic imaging industry.

BACKGROUND OF THE INVENTION

Silver-containing photothermographic imaging materials (that is, thermally developable photosensitive imaging materials) that are imaged with actinic radiation and developed using heat and without liquid processing have been known in the art for many years. Such materials are used in a recording process wherein an image is formed by imagewise exposure of the photothermographic material to specific electromagnetic radiation (for example, X-radiation, or visible, ultraviolet, or infrared radiation) and developed by the use of thermal energy. These materials, also known as "dry silver" materials, generally comprise a support having coated thereon: (a) a photo catalyst (that is, a photosensitive compound such as silver halide) that upon such exposure provides a latent image in exposed grains that are capable of acting as a catalyst for the subsequent formation of a silver image in a development step, (b) a non-photosensitive source of reducible silver ions, (c) a reducing composition (usually including a developer) for the reducible silver ions, and (d) a hydrophilic or hydrophobic binder. The latent image is then developed by application of thermal energy.

In such materials, the photosensitive catalyst is generally a photographic type photosensitive silver halide that is considered to be in catalytic proximity to the non-photosensitive source of reducible silver ions. Catalytic proximity requires intimate physical association of these two components either prior to or during the thermal image development process so that when silver atoms $(Ag^0)_n$, also known as silver specks, clusters, nuclei, or latent image, are generated by irradiation or light exposure of the photosensitive silver halide, those silver atoms are able to catalyze the reduction of the reducible silver ions within a catalytic sphere of influence around the silver atoms [D. H. Klosterboer, *Imaging Processes and Materials*, (*Neblette's Eighth Edition*), J. Sturge, V Walworth, and A. Shepp, Eds., Van Nostrand-Reinhold, New York, 1989, Chapter 9, pp. 279–291]. It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure*, June 1978, item 17029). Other photosensitive materials, such as titanium dioxide, cadmium sulfide, and zinc oxide have also been reported to be useful in place of silver halide as the photocatalyst in photothermographic materials [see for example, Shepard, J. *Appl. Photog. Eng.* 1982, 8(5), 210–212, Shigeo et al., *Nippon Kagaku Kaishi*, 1994, 11, 992–997, and FR 2,254,047 (Robillard)].

The photosensitive silver halide may be made "in-situ," for example by mixing an organic or inorganic halide-containing source with a source of reducible silver ions to achieve partial metathesis and thus causing the in-situ formation of silver halide (AgX) grains throughout the silver source [see, for example, U.S. Pat. No. 3,457,075 (Morgan et al.)]. In addition, photosensitive silver halides and sources of reducible silver ions can be coprecipitated [see Yu. E. Usanov et al., *J. Imag. Sci. Tech.* 1996, 40, 104]. Alternatively, a portion of the reducible silver ions can be completely converted to silver halide, and that portion can be added back to the source of reducible silver ions (see Yu. E. Usanov et al., International Conference on Imaging Science, Sep. 7–11, 1998, pp. 66–70).

The silver halide may also be "preformed" and prepared by an "ex-situ " process whereby the silver halide (AgX) grains are prepared and grown separately. With this technique, one has the possibility of controlling the grain size, grain size distribution, dopant levels, and composition much more precisely, so that one can impart more specific properties to both the silver halide grains and the photothermographic material. The preformed silver halide grains may be introduced prior to and be present during the formation of the source of reducible silver ions. Co-precipitation of the silver halide and the source of reducible silver ions provides a more intimate mixture of the two materials [see for example U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids" or "fatty carboxylic acids". Silver salts of other organic acids or other organic compounds, such as silver imidazoles, silver tetrazoles, silver benzotriazoles, silver benzotetrazoles, silver benzothiazoles and silver acetylides have also been proposed. U.S. Pat. No. 4,260,677 (Winslow et al.) discloses the use of complexes of various inorganic or organic silver salts.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source in the exposed areas is catalytically reduced to form the visible black-and-white negative image while the silver halide and the non-photosensitive silver source in the unexposed areas are not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example a silver carboxylate) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself at least partially converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. Even in so-called "instant photography," the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermographic emulsion as well as during coating, use, storage, and post-processing handling.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

In photothermographic materials, the binder is capable of wide variation and a number of binders (both hydrophilic and hydrophobic) are useful. In contrast, conventional photographic materials are limited almost exclusively to hydrophilic colloidal binders such as gelatin.

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (*Neblette's Eighth Edition*), noted above, *Unconventional Imaging Processes*, E. Brinckman et al. (Eds.), The Focal Press, London and New York, 1978, pp. 74–75, in Zou et al., *J. Imaging Sci. Technol.* 1996, 40, pp. 94–103, and in M. R. V Sahyun, *J. Imaging Sci. Technol.* 1998, 42, 23.

Problem to be Solved

Traditionally, photothermographic materials have suffered from fog (or unwanted non-image density) upon coating the imaging formulations, resulting in poor differentiation between image and non-image areas. The fog level of freshly prepared photothermographic materials is usually referred to as "initial fog" or initial $D_{min}$.

Another type of fog in photothermographic materials arises as the materials are stored or "aged". This type of fog is often referred to as "shelf-aging fog". Adding to the difficulty of controlling shelf-aging fog is the fact that the reducing agent is incorporated into the photothermographic material. A great amount of work has been done to improve the shelf-life characteristics of photothermographic materials.

A third type of fog in photothermographic materials results from the instability of the image and/or background after processing. Photosensitive silver halide remaining in the film may continue to catalyze formation of metallic silver during room light handling or post-processing exposure. This is sometimes known as "post-processing fog" or "silver printout".

Without a means to control all types of fog, a commercially useful photothermographic material is difficult to prepare. A variety of antifoggants have been incorporated into photothermographic materials in order to minimize the formation of fog. For example, U.S. Pat. Nos. 5,028,523 (Skoug), 5,374,514 (Kirk et al.), 5,521,059 (Ishida et al.), and 6,514,678 (Burgmaier et al.) describe various antifoggants that can be used in photothermographic materials.

Most common photothermographic materials are prepared using organic solvents for layer formulation and coating and are therefore often identified as "solvent-based" or "non-aqueous" materials. The various chemical components required for such materials are generally soluble in the organic solvents and insoluble in water.

Photothermographic materials that can be formulated and coated out of water ("aqueous-based" materials) would have a number of manufacturing, environmental, and cost advantages. However, the use of the same chemical components that are present in solvent-based materials is not always possible without the use of expensive or tedious solubilizing or dispersing techniques. Moreover, the chemical components used in solvent-based materials usually do not provide the same sensitometric or chemical benefits when used in aqueous-based materials. Thus, antifoggants normally used in solvent-based photothermographic materials are not necessarily useful in aqueous-based photothermographic materials.

Thus, there is a need for aqueous-based photothermographic materials that exhibit reduced fog, and for antifoggants suitable for such purposes.

SUMMARY OF THE INVENTION

This invention provides a black-and-white aqueous-based photothermographic material that comprises a support having thereon one or more thermally-developable imaging layers comprising a hydrophilic binder and in reactive association, a preformed photosensitive silver halide, a non-photo-sensitive source of reducible silver ions that includes an organic silver salt, and a reducing agent composition for the non-photosensitive source reducible silver ions, and in one or more of the thermally developable imaging layers, a benzothiazolium, benzoselenazolium, or benzotellurazolium salt as an antifoggant.

In preferred embodiments, this invention provides a black-and-white photothermographic material that comprises a transparent support having thereon one or more thermally developable imaging layers comprising a hydrophilic binder that is gelatin or a gelatin derivative, and in reactive association, a preformed photosensitive silver bromide or silver iodobromide present as tabular grains, a non-photosensitive source of reducible silver ions that includes silver benzotriazole, a reducing agent composition for the non-photosensitive source reducible silver ions comprising an ascorbic acid, and in one or more of the thermally developable imaging layers, one or more of Compounds BZ-1, BZ-4, BZ-5, BZ-6, BZ-7, BZ-8, and BZ-9 as identified herein that are present as an antifoggant in an amount of from about 5 to about 25 mmol/mol of total silver.

The present invention also provides a method for the formation of a visible image (usually a black-and-white image) comprising:

A) imagewise exposing the photothermographic material of this invention to electromagnetic radiation to generate a latent image, and B) simultaneously or sequentially, heating the exposed photothermographic material to develop the latent image into a visible image.

Thus, when the photothermographic materials of this invention are heat-developed as described below in a substantially water-free condition after, or simultaneously with, imagewise exposure, a silver image (preferably a black-and-white silver image) is obtained.

In some embodiments, wherein the photothermographic material comprises a transparent support, the image-forming method further comprises:

C) positioning the exposed and heat-developed photothermographic material with the visible image thereon between a source of imaging radiation and an imageable material that is sensitive to the imaging radiation, and D) thereafter exposing the imageable material to the imaging radiation through the visible image in the exposed and heat-developed photothermographic material to provide an image in the imageable material.

In some embodiments, the imaging method described above is carried out by exposing the photothermographic materials of this invention to imaging X-radiation, with or without a phosphor intensifying screen used in association therewith, in an imaging assembly.

The present invention provides images with reduced fog after thermal development with the use of the benzothiazolium, benzoselenazolium, or benzotellurazolium salts as antifoggants in the photothermographic imaging layers. As these compounds reduce fog, there is minimal loss in photospeed and maximum image density ($D_{max}$). In some instances, "print-out" fog is also reduced. These advantages are particularly noticeable in aqueous-based photothermographic imaging formulations that include silver benzotriazole or other heterocyclic silver salts as the non-photosensitive sources of reducible silver ions.

DETAILED DESCRIPTION OF THE INVENTION

The photothermographic materials of this invention can be used in black-and-white photothermography and in electronically generated black-and-white hardcopy recording. They can be used in microfilm applications, in radiographic imaging (for example digital medical imaging), in X-radiography, and in industrial radiography. Furthermore, the absorbance of these photothermographic materials between 350 and 450 nm is desirably low (less than 0.5), to permit their use in the graphic arts area (for example, imagesetting and photo-typesetting), in the manufacture of printing plates, in contact printing, in duplicating ("duping"), and in proofing.

The photothermographic materials of this invention are particularly useful for medical imaging of human or animal subjects in response to visible or X-radiation for use in medical diagnosis. Such applications include, but are not limited to, thoracic imaging, mammography, dental imaging, orthopedic imaging, general medical radiography, therapeutic radiography, veterinary radiography, and autoradiography. When used with X-radiation, the photothermographic materials of this invention may be used in combination with one or more phosphor intensifying screens, with phosphors incorporated within the photothermographic emulsion, or with a combination thereof. The materials of this invention are also useful for non-medical uses of visible or X-radiation (such as X-ray lithography and industrial radiography).

For some applications it may be useful that the photothermographic materials be "double sided" and have photothermographic coatings on both sides of the support.

The photothermographic materials of this invention can be sensitized to different regions of the spectrum, such as ultraviolet, visible, and infrared radiation. The photosensitive silver halide used in these materials has intrinsic sensitivity to blue light. Increased sensitivity to a particular region of the spectrum is imparted through the use of various sensitizing dyes adsorbed to the silver halide grains.

In the photothermographic materials of this invention, the components needed for imaging can be in one or more thermally developable layers. The layer(s) that contain the photosensitive silver halide or non-photosensitive source of reducible silver ions, or both, are referred to herein as thermally developable layers or photothermographic emulsion layer(s). The photosensitive silver halide and the non-photosensitive source of reducible silver ions are in catalytic proximity (that is, in reactive association with each other) and preferably are in the same emulsion layer. "Catalytic proximity" or "reactive association" means that they should be in the same layer or in adjacent layers.

Where the materials contain imaging layers on one side of the support only, various non-imaging layers are usually disposed on the "backside" (non-emulsion side) of the materials, including antihalation layer(s), protective layers, antistatic or conductive layers, and transport enabling layers.

In such instances, various layers are also usually disposed on the "frontside" or emulsion side of the support, including protective topcoat layers, barrier layers, primer layers, interlayers, opacifying layers, antistatic or conductive layers, antihalation layers, acutance layers, auxiliary layers, and others readily apparent to one skilled in the art.

If the photothermographic materials comprise one or more thermally developable imaging layers on both sides of the support, each side can also include one or more protective topcoat layers, primer layers, interlayers, antistatic layers, acutance layers, auxiliary layers, anti-crossover layers, and other layers readily apparent to one skilled in the art.

When the photothermographic materials of this invention are thermally developed as described below in a substantially water-free condition after, or simultaneously with, imagewise exposure, a silver image (preferably a black-and-white silver image) is obtained.

Definitions

As used herein:

In the descriptions of the photothermographic materials of the present invention, "a" or "an" component refers to "at least one" of that component (for example, the benzothiazolium, benzoselenazolium, and benzotellurazolium salts).

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Eastman Kodak Company, Rochester, N.Y., 1977, p. 374.

"Photothermographic material(s)" means a construction comprising at least one photothermographic emulsion layer or a photothermographic set of layers (wherein the silver halide and the source of reducible silver ions are in one layer and the other essential components or desirable additives are distributed, as desired, in an adjacent coating layer) and any supports, topcoat layers, image-receiving layers, blocking layers, antihalation layers, subbing or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

"Photocatalyst" means a photosensitive compound such as silver halide that, upon exposure to radiation, provides a compound that is capable of acting as a catalyst for the subsequent development of the image-forming material.

"Catalytic proximity" or "reactive association" means that the materials are in the same layer or in adjacent layers so that they readily come into contact with each other during thermal imaging and development.

"Emulsion layer", "imaging layer", "thermally developable imaging layer", or "photothermographic emulsion layer" means a layer of a photothermographic material that contains the photosensitive silver halide and/or non-photosensitive source of reducible silver ions. It can also mean a layer of the photothermographic material that contains, in addition to the photosensitive silver halide and/or non-photosensitive source of reducible ions, additional essential components and/or desirable additives (such as the antifoggants and toners). These layers are usually on what is known as the "frontside" of the support, but in some embodiments, they are present on both sides of the support (such embodiments are known as "double-sided" photothermographic materials). In such double-sided materials the layers can be of the same or different chemical composition, thickness, or sensitometric properties.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 to about 405 nm.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

The sensitometric terms "speed", "photospeed", or "photographic speed", $D_{min}$, and $D_{max}$ have conventional definitions known in the imaging arts.

"Transparent" means capable of transmitting visible light or imaging radiation without appreciable scattering or absorption.

The term "equivalent circular diameter" (ECD) is used to define the diameter ($\mu$m) of a circle having the same projected area as a silver halide grain.

The term "aspect ratio" is used to define the ratio of grain ECD to grain thickness.

The term "tabular grain" is used to define a silver halide grain having two parallel crystal faces that are clearly larger than any remaining crystal faces and having an aspect ratio of at least 2. The term "tabular grain emulsion" herein refers to an imaging emulsion containing silver halide grains in which the tabular grains account for more than 70% of the total photosensitive silver halide grain projected area.

The terms "double-sided" and "double-faced coating" are used to define photothermographic materials having one or more of the same or different thermally developable emulsion layers disposed on both sides (front and back) of the support.

The term "RAD" is used to indicate a unit dose of absorbed radiation, that is energy absorption of 100 ergs per gram of tissue.

The terms "kVp" and "MVp" stand for peak voltage applied to an X-ray tube times $10^3$ and $10^6$, respectively.

In the compounds described herein, no particular double bond geometry (for example, cis or trans) is intended by the structures drawn. Similarly, the alternating single and double bonds and localized charges are drawn as a formalism. In reality, both electron and charge delocalization exists throughout the conjugated chain.

As is well understood in this art, for the compounds herein described by Structures I and II below, substitution is not only tolerated, but is often advisable and various substituents are anticipated on the compounds used in the present invention unless otherwise stated. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where a benzene ring structure is shown (including fused ring structures), substituent groups may be placed on the benzene ring structure, but the atoms making up the benzene ring structure may not be replaced.

As a means of simplifying the discussion and recitation of certain substituent groups, the term "group" refers to chemical species that may be substituted as well as those that are not so substituted. Thus, the term "group," such as "alkyl group" is intended to include not only pure hydrocarbon alkyl chains, such as methyl, ethyl, n-propyl, t-butyl, cyclohexyl, and isopropyl, vinyl, allyl, propargyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example $CH_3$—$CH_2$—$CH_2$—O—$CH_2$— and $CH_3$—$CH_2$—$CH_2$—S—$CH_2$—), haloalkyl, nitroalkyl, alkylcarboxy, carboxyalkyl, carboxamido, hydroxyalkyl, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

*Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y 10011).

Other aspects, advantages, and benefits of the present invention are apparent from the detailed description, examples, and claims provided in this application.

The Photocatalyst

As noted above, the photothermographic materials of the present invention include one or more photocatalysts in the photothermographic emulsion layer(s). Useful photocatalysts are typically silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. In preferred embodiments, the silver halide comprises at least 70 mol % silver bromide with the remainder being silver chloride and silver iodide. More preferably, the amount of silver bromide is at least 90 mol %. Silver bromide and silver bromoiodide are more preferred silver halides, with the latter silver halide having up to 10 mol % silver iodide based on total silver halide. Typical techniques for preparing and precipitating silver halide grains are described in *Research Disclosure*, 1978, item 17643.

The shape of the photosensitive silver halide grains used in the present invention is in no way limited. The silver halide grains may have any crystalline habit including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of these crystals can be employed. Silver halide grains having cubic and tabular morphology are preferred, and mixtures of both cubic and tabular grains can be used in the present invention.

The silver halide grains may have a uniform ratio of halide throughout. They may have a graded halide content, with a continuously varying ratio of, for example, silver bromide and silver iodide or they may be of the core-shell type, having a discrete core of one halide ratio, and a discrete shell of another halide ratio. For example, the central regions of the tabular grains may contain at least 1 mol % more iodide than the outer or annular regions of the grains. Core-shell silver halide grains useful in photothermographic materials and methods of preparing these materials are described for example in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference. Mixtures of preformed silver halide grains having different compositions or dopants grains may be employed.

The photosensitive silver halide can be added to (or formed within) the emulsion layer(s) in any fashion as long as it is placed in catalytic proximity to the non-photosensitive source of reducible silver ions.

It is preferred that the silver halide grains be preformed and prepared by an ex-situ process. The silver halide grains prepared ex-situ may then be added to and physically mixed with the non-photosensitive source of reducible silver ions. It is more preferable to form the source of reducible silver ions in the presence of ex-situ-prepared silver halide. In this process, the source of reducible silver ions, such as a long chain fatty acid silver carboxylate (commonly referred to as a silver "soap"), is formed in the presence of the preformed silver halide grains. Co-precipitation of the reducible source of silver ions in the presence of silver halide provides a more intimate mixture of the two materials [see, for example U.S. Pat. No. 3,839,049 (Simons)]. Materials of this type are often referred to as "preformed soaps".

In general, the silver halide grains used in the imaging formulations can vary in average diameter of up to several micrometers ($\mu$m) depending on their desired use. Usually, the silver halide grains have an average particle size of from about 0.01 to about 1.5 $\mu$m. In some embodiments, the average particle size is preferable from about 0.03 to about 1.0 $\mu$m, and more preferably from about 0.05 to about 0.8 $\mu$m.

The average size of the photosensitive, doped silver halide grains is expressed by the average diameter if the grains are spherical, and by the average of the diameters of equivalent circles for the projected images if the grains are cubic or in other non-spherical shapes.

Grain size may be determined by any of the methods commonly employed in the art for particle size measurement. Representative methods are described by in "Particle Size Analysis," ASTM Symposium on Light Microscopy, R. P. Loveland, 1955, pp. 94–122, and in C. E. K. Mees and T. H. James, *The Theory of the Photographic Process*, Third Edition, Macmillan, New York, 1966, Chapter 2. Particle size measurements may be expressed in terms of the projected areas of grains or approximations of their diameters. These will provide reasonably accurate results if the grains of interest are substantially uniform in shape.

In most preferred embodiments of this invention, the silver halide grains useful in this invention are tabular silver halide grains that are considered "ultrathin" and have an average thickness of at least 0.02 $\mu$m and up to and including 0.10 $\mu$m. Preferably, these ultrathin grains have an average thickness of at least 0.03 $\mu$m and more preferably of at least 0.035 μm, and up to and including 0.08 μm and more preferably up to and including 0.07 μm. More details of such grains are provided in U.S. Pat. No. 6,576,410 (Zou et al.), incorporated herein by reference.

In addition, these ultrathin tabular grains have an ECD of at least 0.5 μm, preferably at least 0.75 μm, and more preferably at least 1 μm. The ECD can be up to and including 8 μm, preferably up to and including 6 μm, and more preferably up to and including 5 μm.

The aspect ratio of the useful tabular grains is at least 5:1, preferably at least 10:1, and more preferably at least 15:1. For practical purposes, the tabular grain aspect is generally up to 50:1.

Ultrathin tabular grain size may be determined by any of the methods commonly employed in the art for particle size measurement. Representative methods are described, for example, in "Particle Size Analysis," ASTM Symposium on Light Microscopy, R. P. Loveland, 1955, pp. 94–122, and in C. E. K. Mees and T. H. James, *The Theory of the Photographic Process*, Third Edition, Macmillan, New York, 1966, Chapter 2. Particle size measurements may be expressed in terms of the projected areas of grains or approximations of their diameters. These will provide reasonably accurate results if the grains of interest are substantially uniform in shape.

The ultrathin tabular silver halide grains can also be doped using one or more of the conventional metal dopants known for this purpose including those described in *Research Disclosure* September 1996, item 38957, and U.S. Pat. No. 5,503,970 (Olm et al.), incorporated herein by reference. Preferred dopants include iridium (III or IV) and ruthenium (II or III) salts.

Preformed silver halide emulsions used in the material of this invention can be prepared by aqueous or organic processes and can be unwashed or washed to remove soluble salts. In the latter case, the soluble salts can be removed by ultrafiltration, by chill setting and leaching, or by washing the coagulum [for example, by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.), and U.S. Pat. No. 2,489,341 (Waller et al.)].

It is also effective to use an in-situ process in which a halide-containing compound is added to an organic silver salt to partially convert the silver of the organic silver salt to silver halide. The halogen-containing compound can be inorganic (such as zinc bromide or lithium bromide) or organic (such as N-bromosuccinimide).

Additional methods of preparing these silver halide and organic silver salts and manners of blending them are described in *Research Disclosure*, June 1978, item 17029, U.S. Pat. No. 3,700,458 (Lindholm) and U.S. Pat. No. 4,076,539 (Ikenoue et al.), JP Kokai 49-013224, (Fuji), JP Kokai 50-017216 (Fuji), and JP Kokai 51-042529 (Fuji).

In some instances, it may be helpful to prepare the photosensitive silver halide grains in the presence of a hydroxytetrazindene (such as 4-hydroxy-6-methyl-1,3,3a,7-tetrazaindene) or an N-heterocyclic compound comprising at least one mercapto group (such as 1-phenyl-5-mercaptotetrazole) to provide increased photospeed. Details of this procedure are provided in U.S. Pat. No. 6,413,710 (Shor et al.) that is incorporated herein by reference.

The one or more light-sensitive silver halides used in the photothermographic materials of the present invention are preferably present in an amount of from about 0.005 to about 0.5 mole, more preferably from about 0.01 to about 0.25 mole, and most preferably from about 0.03 to about 0.15 mole, per mole of non-photosensitive source of reducible silver ions.

Chemical Sensitizers

The photosensitive silver halide used in the present invention may be employed without modification. However, it may be chemically sensitized with one or more chemical sensitizing agents such as compounds containing sulfur, selenium, or tellurium, a compound containing gold, platinum, palladium, iron, ruthenium, rhodium, or iridium, a reducing agent such as a tin halide. The details of these procedures are described in T. H. James, *The Theory of the Photographic Process*, Fourth Edition, Eastman Kodak Company, Rochester, N.Y., 1977, Chapter 5, pages 149 to 169, U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), U.S. Pat. No. 5,945,270 (Lok et al.), U.S. Pat. No. 6,159,676 (Lin et al.), and U.S. Pat. No. 6,296,998 (Eikenberry et al.).

In addition, tabular silver halide grains comprising sensitizing dye(s), silver salt epitaxial deposits, and addenda that include a mercaptotetrazole and a tetraazaindene may be chemically sensitized. Such emulsions are described in U.S. Pat. No. 5,691,127 (Daubendiek et al.), incorporated herein by reference.

Sulfur sensitization is performed by adding a sulfur sensitizer and stirring the emulsion at a temperature as high as 40° C. or above for a predetermined time. In addition to the sulfur compound contained in gelatin, various sulfur compounds can be used. Some examples of sulfur sensitizers include thiosulfates (for example, hypo), thioureas (for example, diphenylthiourea, triethylthiourea, N-ethyl-N'-(4-methyl-2-thiazolyl)thiourea and certain tetra-substituted thioureas known as "rapid sulfiding agents"), thioamides (for example, thioacetamide), rhodanines (for example, diethylrhodanine and 5-benzylidene-N-ethylrhodanine), phosphine sulfides (for example, trimethylphosphine sulfide), thiohydantoins, 4-oxo-oxazolidine-2-thiones, dipolysulfides (for example, dimorpholine disulfide, cystine and hexathiocane-thione), mercapto compounds (for example, cysteine), polythionates, and elemental sulfur.

Rapid "sulfiding" agents are also useful in the present invention. Such compounds are described, for example in U.S. Pat. No. 6,296,998 (Eikenberry et al.), and U.S. Pat. No. 6,322,961 (Lam et al.), both noted above. Particularly useful are the tetrasubstituted middle chalcogen thiourea compounds represented by the following Structure RS-1:

(RS-1)

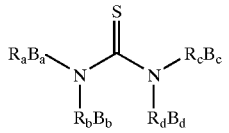

wherein each $R_a$, $R_b$, $R_c$, and $R_d$ group independently represents an alkylene, cycloalkylene, carbocyclic arylene, heterocyclic arylene, alkarylene or aralkylene group, or taken together with the nitrogen atom to which they are attached, $R_a$ and $R_b$ or $R_c$ and $R_d$ can complete a 5- to 7-membered heterocyclic ring, and each of the $B_a$, $B_b$, $B_c$, and $B_d$ groups independently is hydrogen or represents a carboxylic, sulfinic, sulfonic, hydroxamic, mercapto, sulfonamido or primary or secondary amino nucleophilic group, with the proviso that at least one of the $R_aB_a$ through $R_dB_d$ groups contains the nucleophilic group bonded to a urea nitrogen atom through a 1- or 2-membered chain.

Tetrasubstituted middle chalcogen ureas of such formula are disclosed in U.S. Pat. No. 4,810,626 (Burgmaier et al.), the disclosure of which is here incorporated by reference.

A preferred group of rapid sulfiding agents has the general structure RS-1 is that wherein each of the $R_a$, $R_b$, $R_c$, and $R_d$ groups independently represents an alkylene group having 1 to 6 carbon atoms, and each of the $B_a$, $B_b$, $B_c$, and $B_d$ groups independently is hydrogen or represents a carboxylic, sulfinic, sulfonic, hydroxamic group, with the proviso that at least one of the $R_aB_a$ through $R_4B_4$ groups contains the nucleophilic group bonded to a urea nitrogen atom through a 1- or 2-membered chain. Especially preferred rapid sulfiding agents are represented by the following Structures Rs-1a and RS-1b:

(RS-1a)

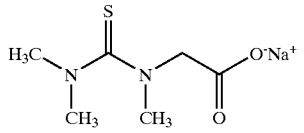

(RS-1b)

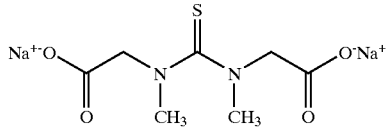

These compounds have been shown to be very effective sensitizers under mild digestion conditions and to produce higher speeds than many other thiourea compounds that lack the specified nucleophilic substituents.

The amount of the sulfur sensitizer to be added varies depending upon various conditions such as pH, temperature and grain size of silver halide at the time of chemical ripening, it is preferably from $10^{-7}$ to $10^{-2}$ mole per mole of silver halide, and more preferably from $10^{-5}$ to $10^{-3}$ mole.

Selenium sensitization is performed by adding a selenium compound and stirring the emulsion at a temperature at least 40° C. for a predetermined time. Examples of the selenium sensitizers include colloidal selenium, selenoureas (for example, N,N-dimethylselenourea, trifluoromethylcarbonyl-trimethylselenourea and acetyl-trimethylselenourea), selenoamides (for example, selenoacetamide and N,N-diethylphenylselenoamide), phosphine selenides (for example, triphenylphosphine selenide and pentafluorophenyl-triphenylphosphine selenide, and methylene-bis[diphenyl-phosphine selenide), selenophosphates (for example, tri-p-tolyl-selenophosphate and tri-n-butyl selenophosphate), selenoketones (for example, selenobenzophenone), isoselenocyanates, selenocarboxylic acids, selenoesters and diacyl selenides. Other selenium compounds such as selenious acid, potassium selenocyanate, selenazoles and selenides can also be used as selenium sensitizers. Some specific examples of useful selenium compounds can be found in U.S. Pat. Nos. 5,158,892 (Sasaki et al.), 5,238,807 (Sasaki et al.), and 5,942,384 (Arai et al.). Still other useful selenium sensitizers are those described in co-pending and commonly assigned U.S. Ser. No. 10/082,516 (filed Feb. 25, 2002 by Lynch, Opatz, Gysling, and Simpson), incorporated herein by reference.

Tellurium sensitizers for use in the present invention are compounds capable of producing silver telluride, which is presumed to serve as a sensitization nucleus on the surface or inside of silver halide grain. Examples of the tellurium sensitizers include telluroureas (for example, tetramethyltellurourea, N,N-dimethylethylene-tellurourea and N,N'-diphenylethylenetellurourea), phosphine tellurides (for example, butyl-diisopropylphosphine telluride, tributylphosphine telluride, tributoxyphosphine telluride and ethoxy-diphenylphosphine telluride), diacyl ditellurides and diacyl tellurides [for example, bis(diphenylcarbamoyl ditelluride, bis(N-phenyl-N-methylcarbamoyl) ditelluride, bis(N-phenyl-N-methylcarbamoyl) telluride and bis (ethoxycarbonyl telluride)], isotellurocyanates, telluroamides, tellurohydrazides, telluroesters (such as butyl hexyl telluroester), telluroketones (such as telluroacetophenone), colloidal tellurium, (di)tellurides and other tellurium compounds (for example, potassium telluride and sodium telluropentathionate). Tellurium compounds for use as chemical sensitizers can be selected from those described in *J. Chem. Soc,. Chem. Commun.* 1980, 635, ibid., 1979, 1102, ibid., 1979, 645, *J. Chem. Soc. Perkin. Trans*, 1980, 1, 2191, *The Chemistry of Organic Selenium and Tellurium Compounds*, S. Patai and Z. Rappoport, Eds., Vol. 1 (1986), and Vol. 2 (1987) and U.S. Pat. No. 5,677,120 (Lushington et al.). Preferred tellurium-containing chemical sensitizers are those described in copending and commonly assigned U.S. Published application No. 2002-0164549 (Lynch et al.), and in co-pending and commonly assigned U.S. Published Application 2003-0073026 (Gysling et al.), both incorporated herein by reference.

Specific examples thereof include the compounds described in U.S. Pat. No. 1,623,499 (Sheppard et al.), U.S. Pat. No. 3,320,069 (Illingsworth), U.S. Pat. No. 3,772,031 (Berry et al.), U.S. Pat. No. 5,215,880 (Kojima et al.), U.S. Pat. No. 5,273,874 (Kojima et al.), U.S. Pat. No. 5,342,750 (Sasaki et al.), British Patent 235,211 (Sheppard), British Patent 1,121,496 (Halwig), British Patent 1,295,462 (Hilson et al.) and British Patent 1,396,696 (Simons), and JP 04-271341 (Morio et al.).

The amount of the selenium or tellurium sensitizer used in the present invention varies depending on silver halide grains used or chemical ripening conditions. However, it is generally from $10^{-8}$ to $10^{-2}$ mole per mole of silver halide, preferably on the order of from $10^{-7}$ to $10^{-3}$ mole. The conditions for chemical sensitization in the present invention are not particularly restricted. However, in general, pH is from 5 to 8, pAg is from 6 to 11, preferably from 7 to 10, and temperature is from 40 to 95° C., preferably from 45 to 85° C.

Noble metal sensitizers for use in the present invention include gold, platinum, palladium and iridium. Gold sensitization is particularly preferred.

The gold sensitizer used for the gold sensitization of the silver halide emulsion used in the present invention may have an oxidation number of 1 or 3, and may be a gold compound commonly used as a gold sensitizer. Examples thereof include chloroauric acid, potassium chloroaurate, auric trichloride, potassium dithiocyanatoaurate, $[AuS_2P(i\text{-}C_4H_9)_2]$, bis-(1,4,5-trimethyl-1,2,4-triazolium-3-thiolate) gold (I) tetrafluoroborate, and pyridyltrichloro gold. U.S. Pat. No. 5,858,637 (Eshelman et al) describes various Au (I) compounds that can be used as chemical sensitizers. Other useful gold compounds can be found in U.S. Pat. No. 5,759,761 (Lushington et al.).

Useful combinations of gold (I) complexes and rapid sulfiding agents are described in U.S. Pat. No. 6,322,961 (Lam et al.). Combinations of gold (III) compounds and either sulfur or tellurium compounds are useful as chemical sensitizers and are described in U.S. Pat. No. 6,423,481 (Simpson et al.), incorporated herein by reference.

Production or physical ripening processes for the silver halide grains used in emulsions of the present invention may be performed under the presence of cadmium salts, sulfites, lead salts, or thallium salts.

Reduction sensitization may also be used. Specific examples compounds useful in reduction sensitization include, but are not limited to, stannous chloride, hydrazine ethanolamine, and thioureaoxide. Reduction sensitization may be performed by ripening the grains while keeping the emulsion at pH 7 or above, or at pAg 8.3 or less. Reduction sensitization may be performed by introducing a single addition portion of silver ion during the formation of the grains.

Spectral Sensitizers

In general, it may also be desirable to add spectral sensitizing dyes to enhance silver halide sensitivity to ultraviolet, visible, and/or infrared radiation. Thus, the photosensitive silver halides may be spectrally sensitized with various dyes that are known to spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. Cyanine dyes, merocyanine dyes and complex merocyanine dyes are particularly useful.

Suitable sensitizing dyes such as those described in U.S. Pat. No. 3,719,495 (Lea), U.S. Pat. No. 4,396,712 (Kinoshita et al.), U.S. Pat. No. 4,690,883 (Kubodera et al.), U.S. Pat. No. 4,840,882 (Iwagaki et al.), U.S. Pat. No. 5,064,753 (Kohno et al.), U.S. Pat. No. 5,281,515 (Delprato et al.), U.S. Pat. No. 5,393,654 (Burrows et al), U.S. Pat. No. 5,441,866 (Miller et al.), U.S. Pat. No. 5,508,162 (Dankosh), U.S. Pat. No. 5,510,236 (Dankosh), U.S. Pat. No. 5,541,054 (Miller et al.), JP 2000-063690 (Tanaka et al.), JP 2000-112054 (Fukusaka et al.), JP 2000-273329 (Tanaka et al.), JP 2001-005145 (Arai), JP 2001-064527 (Oshiyama et al.), and JP 2001-154305 (Kita et al.), can be used in the practice of the invention. All of the publications noted above are incorporated herein by reference.

A summary of generally useful spectral sensitizing dyes is contained in *Research Disclosure*, December 1989, item 308119, Section IV. Additional teaching relating to specific combinations of spectral sensitizing dyes also include U.S. Pat. No. 4,581,329 (Sugimoto et al.), U.S. Pat. No. 4,582,786 (Ikeda et al.), U.S. patent, U.S. Pat. No. 4,609,621 (Sugimoto et al.), U.S. Pat. No. 4,675,279 (Shuto et al.), U.S. Pat. No. 4,678,741 (Yamada et al.), U.S. Pat. No. 4,720,451 (Shuto et al.), U.S. Pat. No. 4,818,675 (Miyasaka et al.), U.S. Pat. No. 4,945,036 (Arai et al.), and U.S. Pat. No. 4,952,491 (Nishikawa et al.). Additional classes of dyes useful for spectral sensitization, including sensitization at other wavelengths are described in *Research Disclosure*, 1994, item 36544, Section V. All of the above references and patents are incorporated herein by reference.

Also useful are spectral sensitizing dyes that decolorize by the action of light or heat. Such dyes are described in U.S. Pat. No. 4,524,128 (Edwards et al.), JP 2001-109101 (Adachi), JP 2001-154305 (Kita et al.), and JP 2001-183770 (Hanyu et al.).

Spectral sensitizing dyes are chosen for optimum photosensitivity, stability, and synthetic ease. They may be added before, after, or during the chemical finishing of the photothermographic emulsion. One useful spectral sensitizing dye for the photothermographic materials of this invention is anhydro-5-chloro-3,3'-di-(3-sulfopropyl)naphtho[1,2-d]thiazolothiacyanine hydroxide, triethylammonium salt.

Spectral sensitizing dyes may be used singly or in combination. When used singly or in combination, the dyes are selected for the purpose of adjusting the wavelength distribution of the spectral sensitivity, and for the purpose of supersensitization. When using a combination of dyes having a supersensitizing effect, it is possible to attain much higher sensitivity than the sum of sensitivities that can be achieved by using each dye alone. It is also possible to attain such supersensitizing action by the use of a dye having no spectral sensitizing action by itself, or a compound that does not substantially absorb visible light. Diaminostilbene compounds are often used as supersensitizers.

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions used in photothermographic materials of this invention can be any organic compound that contains reducible silver (1+) ions that does not contain a carboxylate group. Preferably, it is an organic silver salt that is comparatively stable to light and forms a silver image when heated to 50° C. or higher in the presence of an exposed photocatalyst (such as silver halide) and a reducing composition.

A silver salt of a compound containing an imino group is particularly preferred in the aqueous-based photothermographic formulations used in the practice of this invention. Preferred examples of these compounds include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Particularly preferred are the silver salts of benzotriazole and substituted derivatives thereof. A silver salt of benzotriazole is most preferred. In such embodiments, it is preferred that silver carboxylates are excluded in the photothermographic materials.

Silver salts of sulfonates are also useful in the practice of this invention. Such materials are described for example in U.S. Pat. No. 4,504,575 (Lee). Silver salts of sulfosuccinates are also useful as described for example in EP 0 227 141A1 (Leenders et al.).

Silver salts of compounds containing mercapto or thione groups and derivatives thereof can also be used. Preferred compounds of this type include a heterocyclic nucleus containing 5 or 6 atoms in the ring, at least one of which is a nitrogen atom, and other atoms being carbon, oxygen, or sulfur atoms. Such heterocyclic nuclei include, but are not limited to, triazoles, oxazoles, thiazoles, thiazolines, imidazoles, diazoles, pyridines, and triazines. Representative examples of these silver salts include, but are not limited to, a silver salt of 3-mercapto-4-phenyl-1,2,4-triazole, a silver salt of 2-mercaptobenzimidazole, a silver salt of 2-mercapto-5-aminothiadiazole, a silver salt of 2-(2-ethylglycol-amido)benzothiazole, silver salts of thioglycolic acids (such as a silver salt of a S-alkylthioglycolic acid, wherein the alkyl group has from 12 to 22 carbon atoms), silver salts of dithiocarboxylic acids (such as a silver salt of dithioacetic acid), a silver salt of thioamide, a silver salt of 5-carboxylic-1-methyl-2-phenyl-4-thiopyridine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptotriazole derivative, such as a silver salt of 3-amino-5-benzylthio-1,2,4-triazole), and a silver salt of thione compounds [such as a silver salt of 3-(2-carboxyethyl)-4-methyl-4-thiazoline-2-thione as described in U.S. Pat. No. 3,785,830 (Sullivan et al.). Examples of other useful silver salts of mercapto or thione substituted compounds that do not contain a heterocyclic nucleus include but are not limited to, a silver salt of thioglycolic acids such as a silver salt of an S-alkylthioglycolic acid (wherein the alkyl group has from 12 to 22 carbon atoms), a silver salt of a dithiocarboxylic acid such as a silver salt of a dithioacetic acid, and a silver salt of a thioamide.

Moreover, silver salts of acetylenes can also be used as described, for example in U.S. Pat. No. 4,761,361 (Ozaki et al.) and U.S. Pat. No. 4,775,613 (Hirai et al.).

In less preferred embodiments, the source of reducible silver ions can be provided as silver salts of organic acids including silver salts of carboxylic acids including silver salts of long-chain carboxylic acids. Examples thereof include a silver salt of an aliphatic carboxylic acid (for example having 10 to 30, and preferably 15 to 28, carbon atoms in the fatty acid). Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Preferably, at least silver behenate is used alone or in mixtures with other silver salts.

Representative examples of silver salts of aromatic carboxylic acid and other carboxylic acid group-containing compounds include, but are not limited to, silver benzoate, silver substituted-benzoates (such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate), silver tannate, silver phthalate, silver terephthalate, silver salicylate, silver phenylacetate, and silver pyromellitate.

Silver salts of aliphatic carboxylic acids containing a thioether group as described in U.S. Pat. No. 3,330,663 (Weyde et al.) are also useful. Soluble silver carboxylates comprising hydrocarbon chains incorporating ether or thioether linkages, or sterically hindered substitution in the α- (on a hydrocarbon group) or ortho- (on an aromatic group) position, and displaying increased solubility in coating solvents and affording coatings with less light scattering can also be used. Such silver carboxylates are described in U.S. Pat. No. 5,491,059 (Whitcomb). Mixtures of any of the silver salts described herein can also be used if desired.

Silver salts of dicarboxylic acids are also useful. Such acids may be aliphatic, aromatic, or heterocyclic. Examples of such acids include, for example, phthalic acid, glutamic acid, or homo-phthalic acid.

Non-photosensitive sources of reducible silver ions can also be provided as core-shell silver salts such as those described in U.S. Pat. No. 6,355,408 (Whitcomb et al.), that is incorporated herein by reference. These silver salts include a core comprised of one or more silver salts and a shell having one or more different silver salts.

Still another useful source of non-photosensitive reducible silver ions in the practice of this invention are the silver dimer compounds that comprise two different silver salts as described in U.S. Pat. No. 6,566,045 (Whitcomb), that is incorporated herein by reference. Such non-photosensitive silver dimer compounds comprise two different silver salts, provided that when the two different silver salts comprise straight-chain, saturated hydrocarbon groups as the silver coordinating ligands, those ligands differ by at least 6 carbon atoms.

As one skilled in the art would understand, the non-photosensitive source of reducible silver ions can include various mixtures of the various silver salt compounds described herein, in any desirable proportions. However, if mixtures of silver salts are used, it is preferred that at least 50 mol % of the total silver salts be composed of silver salts of compounds containing an imino group as defined above.

The photocatalyst and the non-photosensitive source of reducible silver ions must be in catalytic proximity (that is, reactive association). It is preferred that these reactive components be present in the same emulsion layer.

The one or more non-photosensitive sources of reducible silver ions are preferably present in an amount of about 5% by weight to about 70% by weight, and more preferably, about 10% to about 50% by weight, based on the total dry weight of the emulsion layers. Stated another way, the amount of the sources of reducible silver ions is generally present in an amount of from about 0.001 to about 0.2 $mol/m^2$ of the dry photothermographic material, and preferably from about 0.01 to about 0.05 $mol/m^2$ of that material.

The total amount of silver (from all silver sources) in the photothermographic materials is generally at least 0.002 $mol/m^2$ and preferably from about 0.01 to about 0.05 $mol/m^2$.

Reducing Agents

The reducing agent (or reducing agent composition comprising two or more components) for the source of reducible silver ions can be any material, preferably an organic material that can reduce silver (I) ion to metallic silver.

Conventional photographic developers can be used as reducing agents, including aromatic di- and tri-hydroxy compounds (such as hydroquinones, gallatic acid and gallic acid derivatives, catechols, and pyrogallols), aminophenols (for example, N-methylaminophenol), sulfonamidophenols, p-phenylenediamines, alkoxynaphthols (for example, 4-methoxy-1-naphthol), pyrazolidin-3-one type reducing agents (for example PHENIDONE®), pyrazolin-5-ones, polyhydroxy spiro-bis-indanes, indan-1,3-dione derivatives, hydroxytetrone acids, hydroxytetronimides, hydroxylamine derivatives such as for example those described in U.S. Pat. No. 4,082,901 (Laridon et al.), hydrazine derivatives, hindered phenols, amidoximes, azines, reductones (for example, ascorbic acid and ascorbic acid derivatives), leuco dyes, and other materials readily apparent to one skilled in the art.

When silver benzotriazole is used as the source of reducible silver ions, ascorbic acid reducing agents are preferred. An "ascorbic acid" reducing agent (also referred to as a developer or developing agent) means ascorbic acid, complexes thereof, and derivatives thereof. Ascorbic acid developing agents are described in a considerable number of publications in photographic processes, including U.S. Pat. No. 5,236,816 (Purol et al.) and references cited therein.

Useful ascorbic acid developing agents include ascorbic acid and the analogues, isomers, complexes, and derivatives thereof. Such compounds include, but are not limited to, D- or L-ascorbic acid, 2,3-dihydroxy-2-cyclohexen-1-one, 3,4-dihydroxy-5-phenyl-2(5H)-furanone, sugar-type derivatives thereof (such as sorboascorbic acid, γ-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, niacinamide ascorbate, potassium ascorbate, isoascorbic acid (or L-erythroascorbic acid), and salts thereof (such as alkali metal, ammonium or others known in the art), endiol type ascorbic acid, an enaminol type ascorbic acid, a thioenol type ascorbic acid, and an enamin-thiol type ascorbic acid, as described for example in U.S. Pat. No. 5,498,511 (Yamashita et al.), EP 0 585,792A1 (Passarella et al.), EP 0 573 700A1 (Lingier et al.), EP 0 588 408A1 (Hieronymus et al.), U.S. Pat. No. 5,089,819 (Knapp), U.S. Pat. No. 5,278,035 (Knapp), U.S. Pat. No. 5,384,232 (Bishop et al.), U.S. Pat. No. 5,376,510 (Parker et al.), Japanese Kokai 7-56286 (Toyoda), U.S. Pat. No. 2,688,549 (James et al.), and *Research Disclosure*, March 1995, item 37152. D-, L-, or D,L-ascorbic acid (and alkali metal salts thereof) or isoascorbic acid (or alkali metal salts thereof) are preferred. Sodium ascorbate and sodium isoascorbate are most preferred. Mixtures of these developing agents can be used if desired.

In some instances, the reducing agent composition comprises two or more components such as a hindered phenol developer and a co-developer that can be chosen from the various classes of reducing agents described below. Ternary developer mixtures involving the further addition of contrast enhancing agents are also useful. Such contrast enhancing agents can be chosen from the various classes of reducing agents described below.

Alternative reducing agents that have been disclosed in dry silver systems including amidoximes such as phenylamidoxime, 2-thienylamidoxime and p-phenoxyphenylamidoxime, azines (for example, 4-hydroxy-3,5-dimethoxybenzaldehydrazine), a combination of aliphatic carboxylic acid aryl hydrazides and ascorbic acid, such as 2,2'-bis(hydroxymethyl)-propionyl-β-phenyl hydrazide in combination with ascorbic acid, a combination of polyhydroxybenzene and hydroxylamine, a reductone and/or a hydrazine [for example, a combination of hydroquinone and bis(ethoxyethyl)hydroxylamine], piperidinohexose reductone or formyl-4-methylphenylhydrazine, hydroxamic acids (such as phenylhydroxamic acid, p-hydroxyphenylhydroxamic acid, and o-alaninehydroxamic acid), a combination of azines and sulfonamidophenols (for example, phenothiazine and 2,6-dichloro-4-benzenesulfonamidophenol), α-cyanophenylacetic acid derivatives (such as ethyl α-cyano-2-methylphenylacetate and ethyl α-cyanophenylacetate), bis-o-naphthols [such as 2,2'-dihydroxyl-1-binaphthyl, 6,6'-dibromo-2,2'-dihydroxy-1,1'-binaphthyl, and bis(2-hydroxy-1-naphthyl)methane], a combination of bis-o-naphthol and a 1,3-dihydroxybenzene derivative (for example, 2,4-dihydroxybenzophenone or 2,4-dihydroxyacetophenone), 5-pyrazolones such as 3-methyl-1-phenyl-5-pyrazolone, reductones (such as dimethylaminohexose reductone, anhydrodihydro-aminohexose reductone and anhydrodihydro-piperidone-hexose reductone), sulfonamidophenol reducing agents (such as 2,6-dichloro-4-benzenesulfonamido-phenol, and p-benzenesulfonamidophenol), 2-phenylindane-1,3-dione and similar compounds, chromans (such as 2,2-dimethyl-7-t-butyl-6-hydroxychroman), 1,4-dihydropyridines (such as 2,6-dimethoxy-3,5-dicarbethoxy-1,4-dihydropyridine), ascorbic acid derivatives (such as 1-ascorbylpalmitate, ascorbylstearate and unsaturated aldehydes and ketones), 3-pyrazolidones, and certain indane-1,3-diones.

An additional class of reducing agents that can be used as developers are substituted hydrazines including the sulfonyl hydrazides described in U.S. Pat. No. 5,464,738 (Lynch et al.). Still other useful reducing agents are described, for example, in U.S. Pat. No. 3,074,809 (Owen), U.S. Pat. No. 3,094,417 (Workman), U.S. Pat. No. 3,080,254 (Grant, Jr.) and U.S. Pat. No. 3,887,417 (Klein et al.). Auxiliary reducing agents may be useful as described in U.S. Pat. No. 5,981,151 (Leenders et al.). All of these patents are incorporated herein by reference.

Additional classes of reducing agents that can be used as co-developers are trityl hydrazides and formyl phenyl hydrazides as described in U.S. Pat. No. 5,496,695 (Simpson et al.).

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

Other Addenda

The photothermographic materials of the invention can also contain other additives such as shelf-life stabilizers, antifoggants, contrast enhancing agents, development accelerators, acutance dyes, post-processing stabilizers or stabilizer precursors, thermal solvents (also known as melt formers), humectants, and other image-modifying agents as would be readily apparent to one skilled in the art.

To further control the properties of photothermographic materials, (for example, contrast, $D_{min}$, speed, or fog), it may be preferable to add one or more heteroaromatic mercapto compounds or heteroaromatic disulfide compounds of the formulae Ar—S—M and Ar—S—S—Ar, wherein M represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Compounds having other heteroaromatic rings and compounds providing enhanced sensitization at other wavelengths are also envisioned to be suitable. For example, heteroaromatic mercapto compounds are described as supersensitizers for infrared photothermographic materials in EP 0 559 228 B1 (Philip Jr. et al.).

The photothermographic materials of the present invention can be further protected against the production of fog and can be stabilized against loss of sensitivity during storage. While not necessary for the practice of the invention, it may be advantageous to add mercury (II) salts to the emulsion layer(s) as an antifoggant. Preferred mercury (II) salts for this purpose are mercuric acetate and mercuric bromide. Other useful mercury salts include those described in U.S. Pat. No. 2,728,663 (Allen).

Other suitable antifoggants and stabilizers that can be used alone or in combination include azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), compounds having $—SO_2CBr_3$ groups as described for example in U.S. Pat. No. 5,594,143 (Kirk et al.) and U.S. Pat. No. 5,374,514

(Kirk et al.), and 2-(tribromomethylsulfonyl)quinoline compounds as described in U.S. Pat. No. 5,460,938 (Kirk et al.).

Stabilizer precursor compounds capable of releasing stabilizers upon application of heat during development can also be used. Such precursor compounds are described in for example, U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzotriazoles (for example alkylsulfonylbenzotriazoles and arylsulfonylbenzotriazoles) have been found to be useful stabilizing compounds (such as for post-processing print stabilizing), as described in U.S. Pat. No. 6,171,767 (Kong et al.).

Furthermore, other specific useful antifoggants/stabilizers are described in more detail in U.S. Pat. No. 6,083,681 (Lynch et al.), incorporated herein by reference.

The photothermographic materials may also include one or more polyhalo antifoggants that include one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds.

Particularly useful antifoggants of this type are polyhalo antifoggants, such as those having a $—SO_2C(X')_3$ group wherein X' represents the same or different halogen atoms.

Another class of useful antifoggants includes those described in U.S. Pat. No. 6,514,678 (Burgmaier et al.), incorporated herein by reference.

Advantageously, the photothermographic materials of this invention also include one or more thermal solvents (also called "heat solvents", "thermosolvents", "melt formers", "melt modifiers," "eutectic formers," "development modifiers," "waxes", or "plasticizers") for improving the reaction speed of the silver-developing redox reaction at elevated temperature.

By the term "thermal solvent" in this invention is meant an organic material that becomes a plasticizer or liquid solvent for at least one of the imaging layers upon heating at a temperature above 60° C. Useful for that purpose are a polyethylene glycol having a mean molecular weight in the range of 1,500 to 20,000 described in U.S. Pat. No. 3,347,675 (Henn et al.). Further are mentioned compounds such as urea, methyl sulfonamide and ethylene carbonate being thermal solvents described in U.S. Pat. No. 3,667,959 (Bojara et al.), and compounds such as tetrahydrothiophene1,1-dioxide, methyl anisate and 1,10-decanediol being described as thermal solvents in *Research Disclosure*, December 1976, item 15027, pp. 26–28. Other representative examples of such compounds include, but are not limited to, niacinamide, hydantoin, 5,5-dimethylhydantoin, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, 1,3-dimethylurea, 1,3-diethylurea, 1,3-diallylurea, meso-erythritol, D-sorbitol, tetrahydro-2-pyrimidone, glycouril, 2-imidazolidone, 2-imidazolidone-4-carboxylic acid, and benzenesulfonamide. Combinations of these compounds can also be used including, for example, a combination of succinimide and 1,3-dimethylurea. Known thermal solvents are disclosed, for example, in U.S. Pat. No. 6,013,420 (Windender), U.S. Pat. No. 3,438,776 (Yudelson), U.S. Pat. No. 5,368,979 (Freedman et al.), U.S. Pat. No. 5,716,772 (Taguchi et al.), U.S. Pat. No. 5,250,386 (Aono et al.), and in *Research Disclosure*, December 1976, item 15022.

Essential Antifoggants

Besides any conventional antifoggants present in the photothermographic materials of this invention, it is essential that certain benzothiazolium, benzoselenazolium, or benzotellurazolium salts be present as antifoggants. These compounds can be generally defined by the following Structure I:

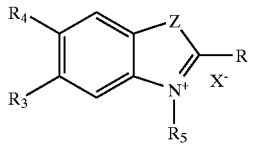

(I)

wherein R is hydrogen or a substituted or unsubstituted alkyl group having 1 to 5 carbon atoms (such as methyl, ethyl, n-propyl, iso-propyl, t-butyl, n-pentyl, methoxymethyl, and ethoxyethyl). R can also be a substituted or unsubstituted alkenyl or alkynyl group having 2 to 5 carbon atoms (such as vinyl, allyl, 1,2-propynyl, and 1,2-pentenyl). Preferably, R is hydrogen or a substituted or unsubstituted alkyl group having 1 to 3 carbon atoms, and more preferably, R is hydrogen, methyl, or ethyl.

$R_3$ and $R_4$ are independently hydrogen, halo (fluoro, chloro, or bromo), cyano, nitro, a substituted or unsubstituted alkyl group having 1 to 5 carbon atoms (as defined above for R), a substituted or unsubstituted alkoxy or alkylthio group having 1 to 5 carbon atoms (wherein the alkyl groups are as defined above for R), substituted or unsubstituted alkenyl or alkynyl groups (as defined above for R), or a substituted or unsubstituted benzyl group. Alternatively, $R_3$ and $R_4$ together can combine to form a saturated or unsaturated fused ring (either 5- or 6-membered heterocyclic or carbocyclic fused ring). Preferably, $R_3$ and $R_4$ are independently hydrogen, chloro, or a substituted or unsubstituted alkoxy group having 1 or 2 carbon atoms. More preferably, $R_3$ and $R_4$ are independently hydrogen or chloro.

$R_5$ is a substituted or unsubstituted cyclic or acyclic organic group having 1 to 10 carbon, nitrogen, and oxygen atoms. Such groups can include, for example alkylene groups connected or terminated with aryl, alkylsulfonyl, alkoxy, thioalkyl, sulfonamido, amido, carbonyl, sulfonyl, oxy, thio, or amino groups. The organic group can be saturated or unsaturated. The organic groups also include substituted or unsubstituted alkenyl and alkynyl groups (as defined above for R).

Alternatively, $R_5$ represents a substituted or unsubstituted aliphatic linking group having 1 to 12 atoms in the chain and terminating in a benzothiazolium, benzoselenazolium, or benzotellurazolium ion. Preferably, the linking group is a substituted or unsubstituted alkylene group having 1 to 10 carbon atoms in the chain (such as polyalkylene and polyoxyalkylene).

$R_5$ is preferably a substituted or unsubstituted alkyl or alkenyl group having 1 to 3 carbon atoms (such as methyl, ethyl, iso-propyl, and 1,2-propenyl).

Z is a sulfur, selenium, or tellurium atom and preferably it is a sulfur atom.

$X^-$ is a suitable anion including but limited to, halide (fluoride, chloride, bromide, and iodide), tetrafluoroborate, hexafluorophosphate, p-toluenesulfonate, trifluoromethanesulfonate, and perchlorate anion. Some anions may be preferred with specific cations to provide optimal reduction in fog, reduction in post-processing printout, or both. For example, iodide may be preferred with benzothiazolium cations to provide optimal reduction in both problems.

Representative compounds having Structure I and useful as antifoggants in the practice of the present invention include the following compounds BZ-1 through BZ-25:
(BZ-1)
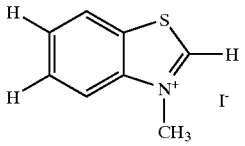
(BZ-2)
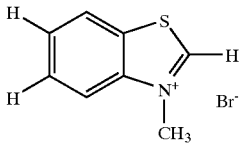
(BZ-3)
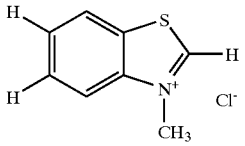
(BZ-4)
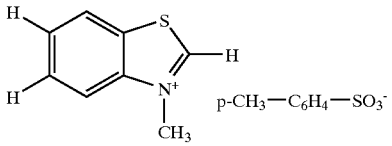
(BZ-5)
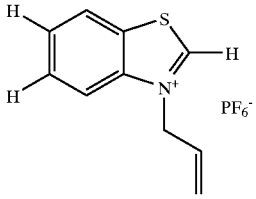
(BZ-6)
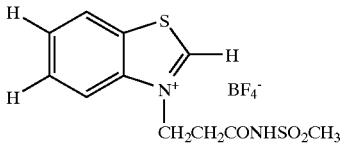
(BZ-7)
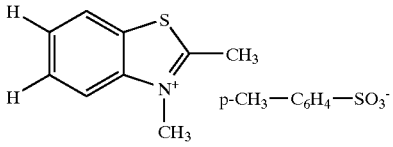
(BZ-8)
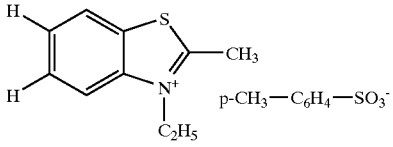
(BZ-9)
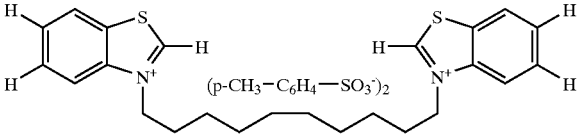
-continued
(BZ-10)
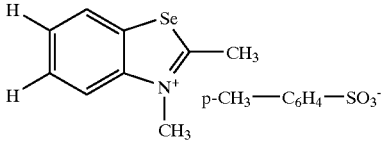
(BZ-11)
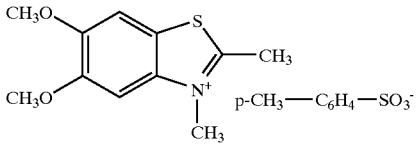
(BZ-12)
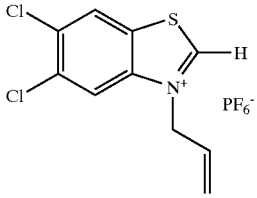
(BZ-13)
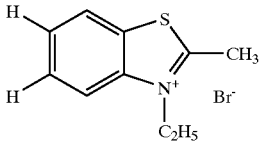
(BZ-14)
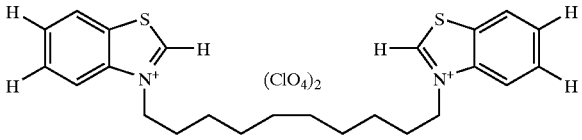
(BZ-15)
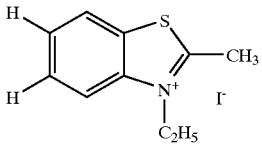
(BZ-16)
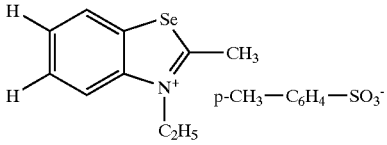
(BZ-17)
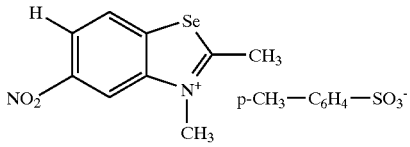
(BZ-18)
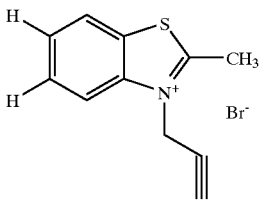

-continued (BZ-19)

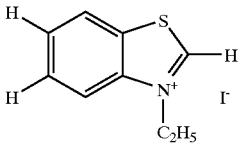

(BZ-20)

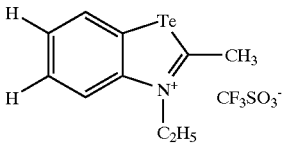

(BZ-21)

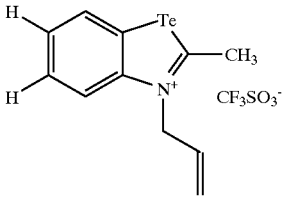

(BZ-22)

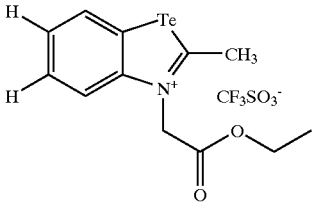

(BZ-23)

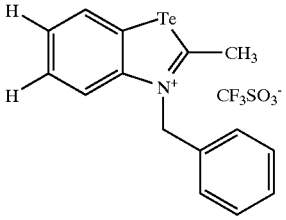

(BZ-24)

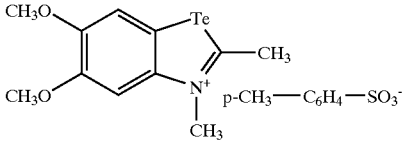

and (BZ-25)

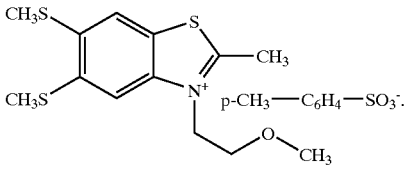

Compounds BZ-1, BZ-4, BZ-5, BZ-6, BZ-7, BZ-8, and BZ-9 are preferred in the practice of this invention. Compound BZ-1 (3-methyl-benzothiazolium iodide) is most preferred. Mixtures of these compounds can also be used. If multiple thermally developable imaging layers are used (on the same or different sides of the support), the same or different antifoggants can be present in the various imaging layers.

The benzothiazolium, benzoselenazolium, and benzotellurazolium salts useful in the present invention can be prepared using known starting materials and conditions. Preparative methods for thiazolium and selenazolium salts are described in U.S. Pat. No. 2,131,038 (Booker et al.). Representative quatemization substituents are described in U.S. Pat. No. 3,282,933 (Nys et al.). A description of carbamoyl and sulfamoyl groups useful as substituents are described in U.S. Pat. No. 4,237,214 (Mifune et al.). A description for the preparation of tellurazolium salts is provided in U.S. Pat. No. 4,578,348 (Freeman et al.). Some of the compounds, namely the preferred 3-methylbenzothiazolium iodide, are available from commercial sources such as Aldrich Chemical Company.

The one or more benzothiazolium, benzoselenazolium, or benzotellurazolium salts are generally present in an amount of at least 5 mmol/mol of total silver, and preferably in an amount of from about 5 to about 25 mmol/mol of total silver.

Toners

"Toners" are compounds that improve image color by contributing to formation of a black image upon development. They also increase the optical density of the developed image. Without them, images are often faint and yellow or brown. Thus, the use of "toners" that improve the black-and-white image is preferred in the practice of this invention. Generally, one or more toners described herein are present in an amount of about 0.01% by weight to about 10%, and more preferably about 0.1% by weight to about 10% by weight, based on the total dry weight of the layer in which it is included. Toners may be incorporated in one or more of the thermally developable imaging layers as well as in adjacent layers such as a protective overcoat or underlying "carrier" layer. The toners can be located on both sides of the support if thermally developable imaging layers are present on both sides of the support.

The toners particularly useful in the practice of this invention are mercaptotriazoles defined by the following Structure II:

(II)

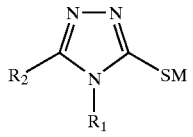

wherein $R_1$ and $R_2$ independently represent hydrogen, a substituted or unsubstituted alkyl group of from 1 to 7 carbon atoms (such as methyl, ethyl, isopropyl, t-butyl, n-hexyl, hydroxymethyl, and benzyl), a substituted or unsubstituted alkenyl group having 2 to 5 carbon atoms in the hydrocarbon chain (such as ethenyl, 1,2-propenyl, methallyl, and 3-buten-1-yl), a substituted or unsubstituted cycloalkyl group having 5 to 7 carbon atoms forming the ring (such as cyclopenyl, cyclohexyl, and 2,3-dimethylcyclohexyl), a substituted or unsubstituted aromatic or non-aromatic heterocyclyl group having 5 or 6 carbon, nitrogen, oxygen, or sulfur atoms forming the aromatic or non-aromatic heterocyclyl group (such as pyridyl, furanyl, thiazolyl, and thienyl), an amino or amide group (such as amino or acetamido), and a substituted or unsubstituted aryl group having 6 to 10 carbon atoms forming the aromatic ring (such as phenyl, tolyl, naphthyl, and 4-ethoxyphenyl).

In addition, $R_1$ and $R_2$ can be a substituted or unsubstituted $Y_1$—$(CH_2)_k$— group wherein $Y_1$ is a substituted or unsubstituted aryl group having 6 to 10 carbon atoms as defined above for $R_1$ and $R_2$, or a substituted or unsubstituted aromatic or non-aromatic heterocyclyl group as defined above for $R_1$. Also, k is 1–3.

Alternatively, $R_1$ and $R_2$ taken together can form a substituted or unsubstituted, saturated or unsaturated 5- to 7-membered aromatic or non-aromatic nitrogen-containing heterocyclic ring comprising carbon, nitrogen, oxygen, or sulfur atoms in the ring (such as pyridyl, diazinyl, triazinyl, piperidine, morpholine, pyrrolidine, pyrazolidine, and thiomorpholine).

Still again, $R_1$ or $R_2$ can represent a divalent linking group (such as a phenylene, methylene, or ethylene group) linking two mercaptotriazole groups, and $R_2$ may further represent carboxy or its salts.

M is hydrogen or a monovalent cation (such as an alkali metal cation, an ammonium ion, or a pyridinium ion). Preferably, M is hydrogen.

The definition of mercaptotriazoles of Structure II also includes the following provisos:

1) $R_1$ and $R_2$ are not simultaneously hydrogen.
2) When $R_1$ is substituted or unsubstituted phenyl or benzyl, $R_2$ is not substituted or unsubstituted phenyl or benzyl.
3) When $R_2$ is hydrogen, $R_1$ is not an allenyl, 2,2-diphenylethyl, α-methylbenzyl, or a phenyl group having a cyano or a sulfonic acid substituent.
4) When $R_1$ is an unsubstituted benzyl or phenyl group, $R_2$ is not substituted 1,2-dihydroxyethyl, or 2-hydroxy-2-propyl.
5) When $R_1$ is hydrogen, $R_2$ is not 3-phenylthiopropyl.

In addition, the photothermographic material is further defined wherein:

6) One or more thermally developable imaging layers has a pH less than 7.

Preferably, $R_1$ is a methyl, t-butyl, or a substituted or unsubstituted phenyl or benzyl group. More preferably $R_1$ is benzyl. Also, $R_1$ can represent a divalent linking group (such as a 1,4-phenylene, methylene, or ethylene group) that links two mercaptotriazole groups.

Preferably, $R_2$ is hydrogen, acetamido, or hydroxymethyl. More preferably, $R_2$ is hydrogen. Also, $R_2$ can represent a divalent linking group (such as a phenylene, methylene, or ethylene group) that links two mercaptotriazole groups.

It is well known that heterocyclic compounds exist in tautomeric forms. Both annular (ring) tautomerism and substituent tautomerism are possible. In 1,2,4-mercaptotriazoles, at least three tautomers (a 1H form, a 2H form, and a 4H form) are possible.

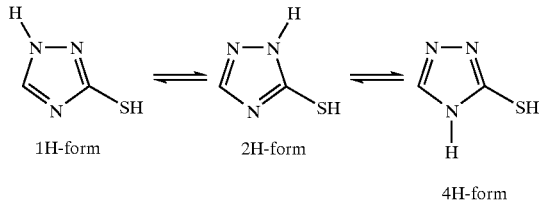

In 1,2,4-mercaptotriazoles, thiol-thione substituent tautomerism is also possible.

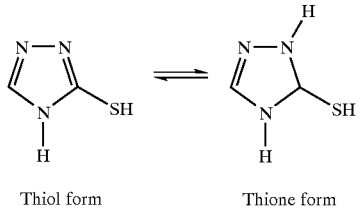

Interconversion among these tautomers can occur rapidly and individual tautomers are usually not isolatable, although one tautomeric form may predominate. For the mercaptotriazoles of this invention, the 4H -thiol structural formalism is used with the understanding that such tautomers do exist.

Representative compounds having Structure II and useful as toners in the practice of the present invention include the following compounds T-1 through T-59:

(T-1)

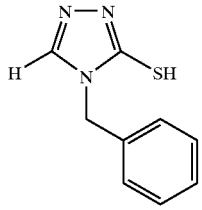

(T-2)

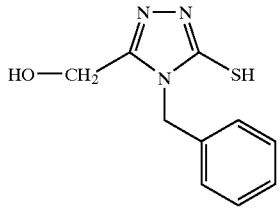

(T-3)

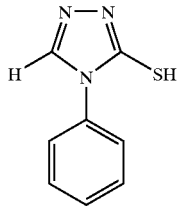

(T-4)

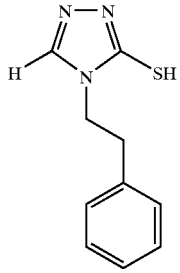

(T-5)

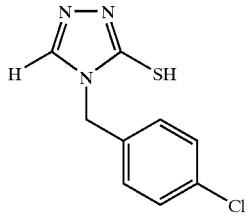

(T-6)

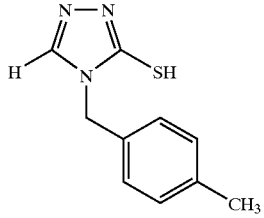

-continued
(T-7)
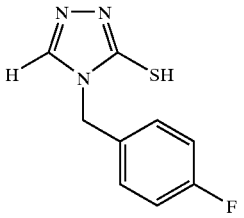
(T-8)
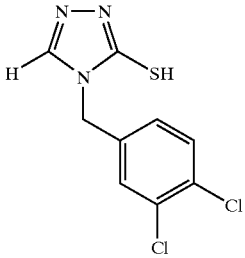
(T-9)
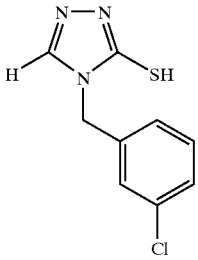
(T-10
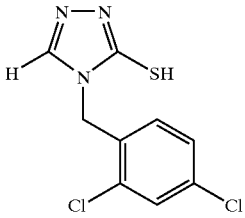
(T-11)
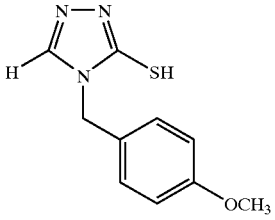
(T-12)
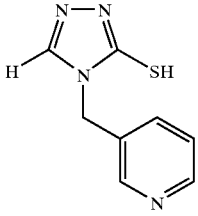
-continued
(T-13)
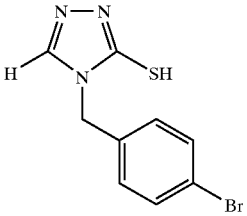
(T-14)
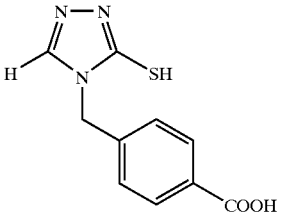
(T-15)
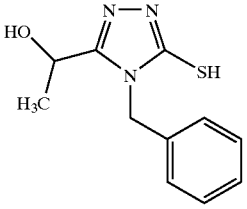
(T-16)
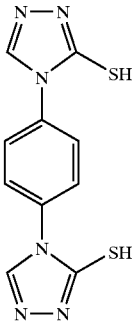
(T-17)
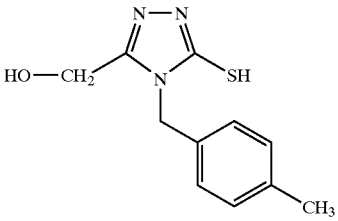
(T-18)
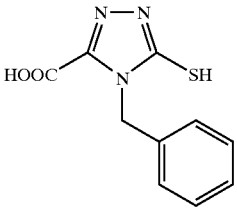

-continued
(T-19)
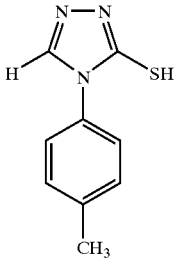
(T-20)
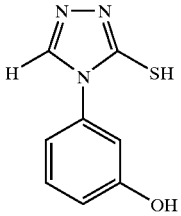
(T-21)
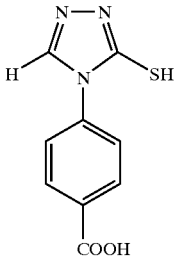
(T-22)
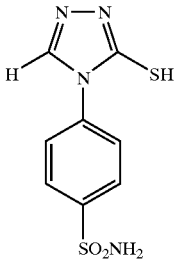
(T-23)
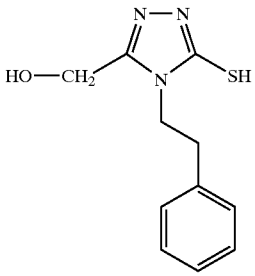
(T-24)
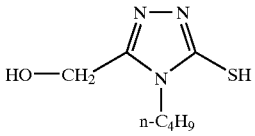
-continued
(T-25)
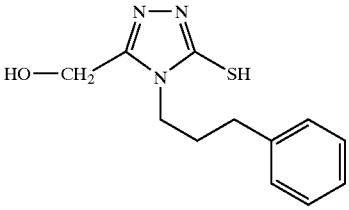
(T-26)
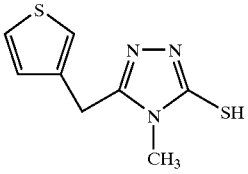
(T-27)
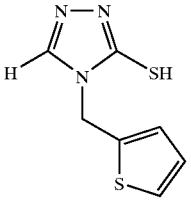
(T-28)
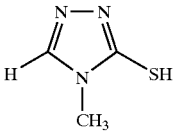
(T-29)
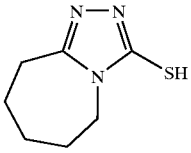
(T-30)
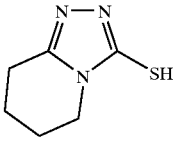
(T-31)
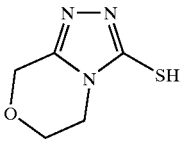
(T-32)
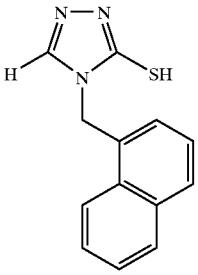

-continued
(T-33)
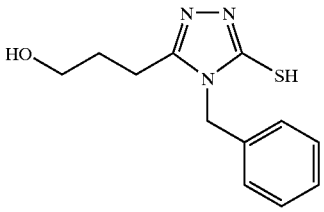
(T-34)
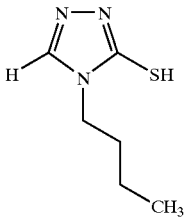
(T-35)
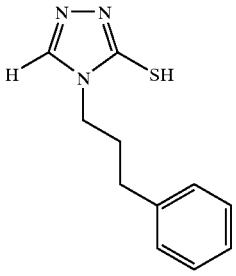
(T-36)
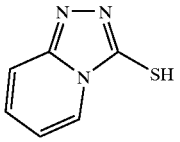
(T-37)
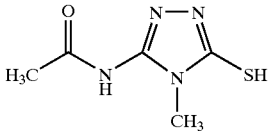
(T-38)
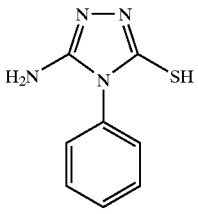
(T-39)
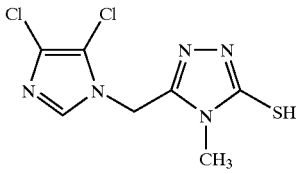
(T-40)
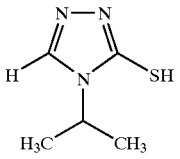
-continued
(T-41)
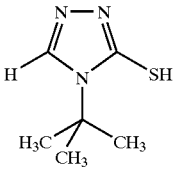
(T-42)
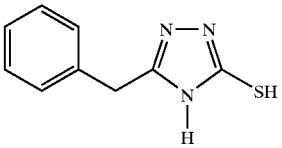
(T-43)
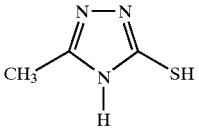
(T-44)
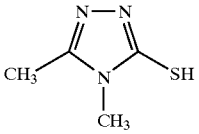
(T-45)
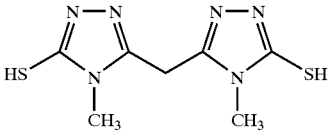
(T-46)
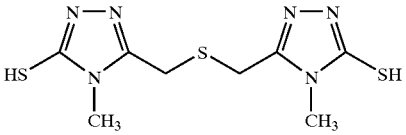
(T-47)
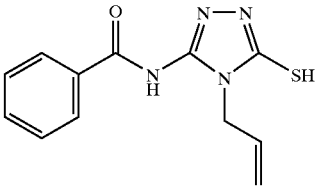
(T-48)
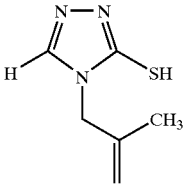
(T-49)
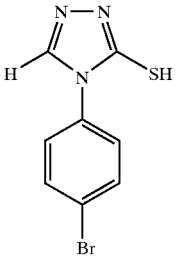

-continued (T-50)

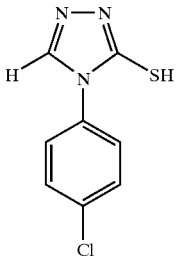

(T-51)

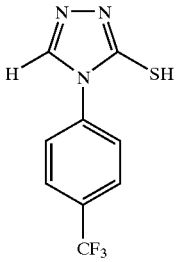

(T-52)

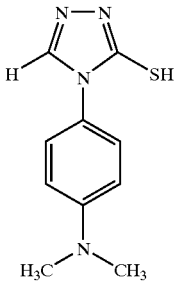

(T-53)

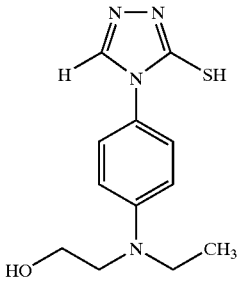

(T-54)

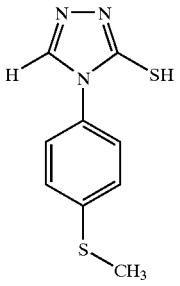

(T-55)

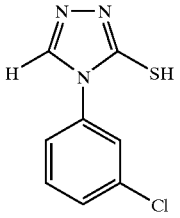

-continued (T-56)

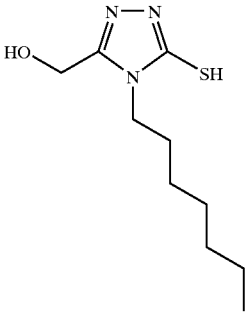

(T-57)

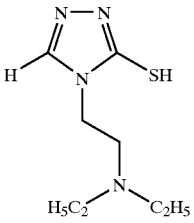

(T-58)

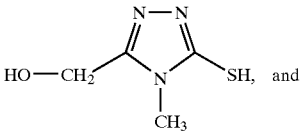

and (T-59)

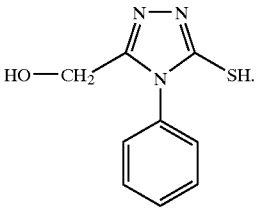

Compounds T-1, T-2, T-3, T-11, T-12, T-16, T-37, T-41, and T-44 are preferred in the practice of this invention, and Compounds T-1, T-2, and T-3 are most preferred.

The mercaptotriazole toners described herein can be readily prepared using known synthetic methods. For example, compound T-1 can be prepared as described in U.S. Pat. No. 4,628,059 (Finkelstein et al.). Additional preparations of various mercaptotriazoles are described in U.S. Pat. No. 3,769,411 (Greenfield et al.), U.S. Pat. No. 4,183,925 (Baxter et al.), U.S. Pat. No. 6,074,813 (Asanuma et al.), DE 1 670 604 (Korosi), and in *Chem. Abstr*. 1968, 69, 52114j. Some mercaptotriazole compounds are commercially available.

As would be understood by one skilled in the art, two or more mercaptotriazole toners as defined by Structure II can be used in the practice of this invention if desired, and the multiple toners can be located in the same or different layers of the photothermographic materials.

Additional conventional toners can also be included with the one or more mercaptotriazoles described above. Such compounds are well known materials in the photothermographic art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (AGFA).

Examples of additional conventional toners include, but are not limited to, phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes [such as hexaaminecobalt(3+) trifluoroacetate], mercaptans (such as, 2,4-dimercaptopyrimidine, and 2,5-dimercapto-1,3,4-thiadiazole), N-(aminomethyl)aryldicarboximides [such as (N,N-dimethylaminomethyl)phthalimide and N-(dimethylaminomethyl)-naphthalene-2,3-dicarboximide], a combination of blocked pyrazoles, isothiuronium derivatives, and certain photobleach agents [such as a combination of N,N'-hexamethylene-bis(1-carbamoyl-3,5-dimethylpyrazole), 1,8-(3,6-diazaoctane)bis(isothiuronium) trifluoroacetate, and 2-(tribromomethylsulfonyl benzothiazole)], merocyanine dyes {such as 3-ethyl-5-[(3-ethyl-2-benzo-thiazolinylidene)-1-methyl-ethylidene]-2-thio-2,4-o-azolidinedione}, phthalazine and derivatives thereof [such as those described in U.S. Pat. No. 6,146,822 (Asanuma et al.)], phthalazinone and phthalazinone derivatives, or metal salts or these derivatives [such as 4-(1-naphthyl)phthalazinone, 6-chlorophthalazinone, 5,7-dimethoxyphthalazinone, and 2,3-dihydro-1,4-phthalazinedione], a combination of phthalazine (or derivative thereof) plus one or more phthalic acid derivatives (such as phthalic acid, 4-methylphthalic acid, 4-nitrophthalic acid, and tetrachlorophthalic anhydride), quinazolinediones, benzoxazine or naphthoxazine derivatives, rhodium complexes functioning not only as tone modifiers but also as sources of halide ion for silver halide formation in-situ [such as ammonium hexachlororhodate (III), rhodium bromide, rhodium nitrate, and potassium hexachlororhodate (III)], benzoxazine-2,4-diones (such as 1,3-benzoxazine-2,4-dione, 8-methyl-1,3-benzoxazine-2,4-dione and 6-nitro-1,3-benzoxazine-2,4-dione), pyrimidines and asym-triazines (such as 2,4-dihydroxypyrimidine, 2-hydroxy-4-aminopyrimidine and azauracil) and tetraazapentalene derivatives [such as 3,6-dimercapto-1,4-diphenyl-1H,4H-2,3a,5,6a-tetraazapentalene and 1,4-di-(o-chlorophenyl)-3,6-dimercapto-1H,4H-2,3a,5,6a-tetraazapentalene].

Phthalazine and phthalazine derivatives [such as those described in U.S. Pat. No. 6,146,822 (noted above), incorporated herein by reference] are particularly useful as additional conventional toners that can be used in admixture with the mercaptotriazoles of Structure II described herein. Phthalazine and derivatives thereof can be used in any layer of the photothermographic material on either side of the support.

Binders

The photocatalyst (such as photosensitive silver halide), the non-photosensitive source of reducible silver ions, the reducing agent composition, antifoggant(s), toner(s), and any other additives used in the present invention are added to and coated in one or more hydrophilic binders. Thus, aqueous-based formulations are be used to prepare the photothermographic materials of this invention. Mixtures of different types of hydrophilic binders can also be used.

Examples of useful hydrophilic binders include, but are not limited to, proteins and protein derivatives, gelatin and gelatin derivatives (hardened or unhardened, including alkali- and acid-treated gelatins, and deionized gelatin), cellulosic materials such as hydroxymethyl cellulose and cellulosic esters, acrylamide/methacrylamide polymers, acrylic/methacrylic polymers, polyvinyl pyrrolidones, polyvinyl alcohols, poly(vinyl lactams), polymers of sulfoalkyl acrylate or methacrylates, hydrolyzed polyvinyl acetates, polyamides, polysaccharides (such as dextrans and starch ethers), and other naturally occurring or synthetic vehicles commonly known for use in aqueous-based photographic emulsions (see for example *Research Disclosure*, item 38957, noted above). Cationic starches can also be used as peptizers for emulsions containing tabular grain silver halides as described in U.S. Pat. No. 5,620,840 (Maskasky) and U.S. Pat. No. 5,667,955 (Maskasky).

Particularly useful hydrophilic binders are gelatin, gelatin derivatives, polyvinyl alcohols, and cellulosic materials. Gelatin and its derivatives are most preferred, and comprise at least 75 weight % of total binders when a mixture of binders is used.

"Minor" amounts of hydrophobic binders can also be present as long as more than 50% (by weight of total binders) is composed of hydrophilic binders. Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available as BUTVAR® B79 (Solutia, Inc.) and PIOLOFORM® BS-18 or PIOLOFORM® BL-16 (Wacker Chemical Company). Aqueous dispersions (or latexes) of hydrophobic binders may also be used.

Hardeners for various binders may be present if desired. Useful hardeners are well known and include vinyl sulfone compounds as described in U.S. Pat. No. 6,143,487 (Philip et al.) and aldehydes and various other hardeners as described in U.S. Pat. No. 6,190,822 (Dickerson et al.). The hydrophilic binders used in the photothermographic materials are generally partially or fully hardened using any conventional hardener. Useful hardeners are well known and are described, for example, in T. H. James, *The Theory of the Photographic Process*, Fourth Edition, Eastman Kodak Company, Rochester, N.Y., 1977, Chapter 2, pp. 77–78.

Where the proportions and activities of the photothermographic materials require a particular developing time and temperature, the binder(s) should be able to withstand those conditions. Generally, it is preferred that the binder does not decompose or lose its structural integrity at 120° C. for 60 seconds. It is more preferred that it does not decompose or lose its structural integrity at 177° C. for 60 seconds.

The polymer binder(s) is used in an amount sufficient to carry the components dispersed therein. An effective range of binder amounts can be readily determined by one skilled in the art. Preferably, a binder is used at a level of about 10% by weight to about 90% by weight, and more preferably at a level of about 20% by weight to about 70% by weight, based on the total dry weight of the layer in which it is included. The amount of binders in double-sided photothermographic materials may be the same or different.

Support Materials

The photothermographic materials of this invention comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are composed of polymers having good heat stability, such as polyesters and polycarbonates. Support materials may also be treated or annealed to reduce shrinkage and promote dimensional stability. Polyethylene terephthalate film is a particularly preferred support. Various support materials are described, for example, in *Research Disclosure*, August 1979, item 18431. A method of making dimensionally stable polyester films is described in *Research Disclosure*, September 1999, item 42536.

It is also useful to use supports comprising dichroic mirror layers wherein the dichroic mirror layer reflects radiation at least having the predetermined range of wavelengths to the emulsion layer and transmits radiation having a wavelength outside the predetermined range of wavelengths. Such dichroic supports are described in U.S. Pat. No. 5,795,708 (Boutet), incorporated herein by reference.

It is further possible to use transparent, multilayer, polymeric supports comprising numerous alternating layers of at least two different polymeric materials. Such multilayer polymeric supports preferably reflect at least 50% of actinic radiation in the range of wavelengths to which the photothermographic sensitive material is sensitive, and provide photothermographic materials having increased speed. Such transparent, multilayer, polymeric supports are described in WO 02/21208 A1 (Simpson et al.) that is incorporated herein by reference.

Opaque supports such as dyed polymeric films and resin-coated papers that are stable to high temperatures can also be used.

Support materials can contain various colorants, pigments, antihalation or acutance dyes if desired. Support materials may be treated using conventional procedures (such as corona discharge) to improve adhesion of overlying layers, or subbing or other adhesion-promoting layers can be used. Useful subbing layer formulations include those conventionally used for photographic materials such as vinylidene halide polymers.

Phosphors

In some embodiments, phosphors can be added to the imaging layers containing the photosensitive silver halide to increase photospeed as described for example in U.S. Pat. No. 6,573,033 (Simpson et al.), incorporated herein by reference.

Phosphors are materials that emit infrared, visible, or ultraviolet radiation upon excitation. An intrinsic phosphor is a material that is naturally (that is, intrinsically) phosphorescent. An "activated" phosphor is one composed of a basic material that may or may not be an intrinsic phosphor, to which one or more dopant(s) has been intentionally added. These dopants "activate" the phosphor and cause it to emit infrared, visible, or ultraviolet radiation. For example, in $Gd_2O_2S$:Tb, the Th atoms (the dopant/activator) give rise to the optical emission of the phosphor. Some phosphors, such as BaFBr, are known as storage phosphors. In these materials, the dopants are involved in the storage as well as the emission of radiation.

Any conventional or useful phosphor can be used, singly or in mixtures, in the imaging layers. For example, useful phosphors are described in numerous references relating to fluorescent intensifying screens, including but not limited to, *Research Disclosure*, August 1979, item 18431, Section IX, X-ray Screens/Phosphors, and U.S. Pat. No. 2,303,942 (Wynd et al.), U.S. Pat. No. 3,778,615 (Luckey), U.S. Pat. No. 4,032,471 (Luckey), U.S. Pat. No. 4,225,653 (Brixner et al.), U.S. Pat. No. 3,418,246 (Royce), U.S. Pat. No. 3,428,247 (Yocon), U.S. Pat. No. 3,725,704 (Buchanan et al.), U.S. Pat. No. 2,725,704 (Swindells), U.S. Pat. No. 3,617,743 (Rabatin), U.S. Pat. No. 3,974,389 (Ferri et al.), U.S. Pat. No. 3,591,516 (Rabatin), U.S. Pat. No. 3,607,770 (Rabatin), U.S. Pat. No. 3,666,676 (Rabatin), U.S. Pat. No. 3,795,814 (Rabatin), U.S. Pat. No. 4,405,691 (Yale), U.S. Pat. No. 4,311,487 (Luckey et al.), U.S. Pat. No. 4,387,141 (Patten), U.S. Pat. No. 5,021,327 (Bunch et al.), U.S. Pat. No. 4,865,944 (Roberts et al.), U.S. Pat. No. 4,994,355 (Dickerson et al.), U.S. Pat. No. 4,997,750 (Dickerson et al.), U.S. Pat. No. 5,064,729 (Zegarski), U.S. Pat. No. 5,108,881 (Dickerson et al.), U.S. Pat. No. 5,250,366 (Nakajima et al.), U.S. Pat. No. 5,871,892 (Dickerson et al.), EP 0 491 116A1 (Benzo et al.), the disclosures of all of which are incorporated herein by reference with respect to the phosphors.

Useful classes of phosphors include, but are not limited to, calcium tungstate ($CaWO_4$), activated or unactivated lithium stannates, niobium and/or rare earth activated or unactivated yttrium, lutetium, or gadolinium tantalates, rare earth (such as terbium, lanthanum, gadolinium, cerium, and lutetium)-activated or unactivated middle chalcogen phosphors such as rare earth oxychalcogenides and oxyhalides, and terbium-activated or unactivated lanthanum and lutetium middle chalcogen phosphors.

Still other useful phosphors are those containing hafnium as described for example in U.S. Pat. No. 4,988,880 (Bryan et al.), U.S. Pat. No. 4,988,881 (Bryan et al.), U.S. Pat. No. 4,994,205 (Bryan et al.), U.S. Pat. No. 5,095,218 (Bryan et al.), U.S. Pat. No. 5,112,700 (Lambert et al.), U.S. Pat. No. 5,124,072 (Dole et al.), and U.S. Pat. No. 5,336,893 (Smith et al.), the disclosures of which are all incorporated herein by reference.

Photothermographic Formulations

The desired components, including one or more antifoggants of Structure I noted above, can be formulated with a hydrophilic binder (such as gelatin or a gelatin-derivative) in water or water-organic solvent mixtures to provide aqueous-based coating formulations. The solvent system used to provide these formulations is at least 80 volume % water (preferably at least 90 volume % water). Organic solvents such as water-miscible alcohols, acetone, or methyl ethyl ketone, may also be included.

As noted above, one or more thermally developable imaging layers has a pH less than 7. The pH of these layers may be conveniently controlled to be acidic by addition of ascorbic acid as the developer. Alternatively, the pH may be controlled by adjusting the pH of the silver salt dispersion prior to coating with mineral acids such as, for example, sulfuric acid or nitric acid or by addition of organic acids such as citric acid. It is preferred that the pH of the one or more imaging layers be less than 7 and preferably less than 6. This pH value can be determined using a surface pH electrode after placing a drop of $KNO_3$ solution on the sample surface. Such electrodes are available from Corning (Corning, N.Y.).

Photothermographic materials of the invention can contain plasticizers and lubricants such as polyalcohols and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads including beads of the type described in U.S. Pat. No. 2,992,101 (Jelley et al.) and U.S. Pat. No. 2,701,245 (Lynn). Polymeric fluorinated surfactants may also be useful in one or more layers of the photothermographic materials for various purposes, such as improving coatability and optical density uniformity as described in U.S. Pat. No. 5,468,603 (Kub).

U.S. Pat. No. 6,436,616 (Geisler et al.) describes various means of modifying photothermographic materials to reduce what is known as the "woodgrain" effect, or uneven optical density. This effect can be reduced or eliminated by several means, including treatment of the support, adding matting agents to the topcoat, using acutance dyes in certain layers or other procedures described in the noted publication.

The photothermographic materials of this invention can include antistatic or conducting layers. Such layers may contain soluble salts (for example, chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described in U.S. Pat. No. 5,368,995 (Christian et al.), and electrically-conductive metal-containing particles dispersed in a polymeric binder such as those described in EP 0 678 776A1 (Melpolder et al.). Other antistatic agents are well known in the art.

Still other conductive compositions include one or more fluoro-chemicals each of which is a reaction product of $R_f$—$CH_2CH_2$—$SO_3H$ with an amine wherein $R_f$ comprises 4 or more fully fluorinated carbon atoms. These antistatic compositions are described in more detail in copending U.S. Ser. No. 10/107,551 (filed Mar. 27, 2002 by Sakizadeh, LaBelle, Orem, and Bhave) that is incorporated herein by reference.

The photothermographic materials of this invention can be constructed of one or more layers on a support. Single layer materials should contain the photocatalyst, the non-photosensitive source of reducible silver ions, the reducing composition, the binder, as well as optional materials such as acutance dyes, coating aids and other adjuvants.

Two-layer constructions comprising a single imaging layer coating containing all the ingredients and a surface protective topcoat are generally found in the materials of this invention. However, two-layer constructions containing photocatalyst and non-photosensitive source of reducible silver ions in one imaging layer (usually the layer adjacent to the support) and the reducing composition and other ingredients in the second imaging layer or distributed between both layers are also envisioned.

For double-sided photothermographic materials, each side of the support can include one or more of the same or different imaging layers, interlayers, and protective topcoat layers. In such materials preferably a topcoat is present as the outermost layer on both sides of the support. The thermally developable layers on opposite sides can have the same or different construction and can be overcoated with the same or different protective layers.

Layers to promote adhesion of one layer to another in photothermographic materials are also known, as described for example in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described for example in U.S. Pat. No. 5,928,857 (Geisler et al.).

Layers to reduce emissions from the film may also be present, including the polymeric barrier layers described in U.S. Pat. No. 6,352,819 (Kenney et al.), U.S. Pat. No. 6,352,820 (Bauer et al.), and U.S. Pat. No. 6,420,102 (Bauer et al.), in copending and commonly assigned U.S. Ser. No. 10/341,747 (filed Jan. 14, 2003 by Rao, Hammerschmidt, Bauer, Kress, and Miller), and in copending and commonly assigned U.S. Ser. No. 10/351,814 (filed Jan. 27, 2003 by Hunt), all incorporated herein by reference.

Photothermographic formulations described herein can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford). A typical coating gap for the emulsion layer can be from about 10 to about 750 $\mu$m, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

When the layers are coated simultaneously using various coating techniques, a "carrier" layer formulation comprising a single-phase mixture of the two or more polymers described above may be used. Such formulations are described in U.S. Pat. No. 6,355,405 (Ludemann et al.).

Mottle and other surface anomalies can be reduced in the photothermographic materials of this invention by incorporation of a fluorinated polymer as described for example in U.S. Pat. No. 5,532,121 (Yonkoski et al.) or by using particular drying techniques as described, for example in U.S. Pat. No. 5,621,983 (Ludemann et al.).

Preferably, two or more layers are applied to a film support using slide coating. The first layer can be coated on top of the second layer while the second layer is still wet. The first and second fluids used to coat these layers can be the same or different.

While the first and second layers can be coated on one side of the film support, manufacturing methods can also include forming on the opposing or backside of said polymeric support, one or more additional layers, including an antihalation layer, an antistatic layer, or a layer containing a matting agent (such as silica), an imaging layer, a protective topcoat layer, or a combination of such layers.

It is also contemplated that the photothermographic materials of this invention can include thermally developable imaging (or emulsion) layers on both sides of the support and at least one infrared radiation absorbing heat-bleachable composition in an antihalation underlayer beneath layers on one or both sides of the support.

Photothermographic materials having thermally developable layers disposed on both sides of the support often suffer from "crossover". Crossover results when radiation used to image one side of the photothermographic material is transmitted through the support and images the photothermographic layers on the opposite side of the support. Such radiation causes a lowering of image quality (especially sharpness). As crossover is reduced, the sharper becomes the image. Various methods are available for reducing crossover. Such "anti-crossover" materials can be materials specifically included for reducing crossover or they can be acutance or antihalation dyes. In either situation it is necessary that they be rendered colorless during processing.

To promote image sharpness, photothermographic materials according to the present invention can contain one or more layers containing acutance, filter, crossover prevention (anti-crossover), anti-irradiation and/or antihalation dyes. These dyes are chosen to have absorption close to the exposure wavelength and are designed to absorb scattered light. One or more antihalation dyes may be incorporated into one or more antihalation layers according to known techniques, as an antihalation backing layer, as an antihalation underlayer, or as an antihalation overcoat. Additionally, one or more acutance dyes may be incorporated into one or more layers such as a thermally developable imaging layer, primer layer, underlayer, or topcoat layer (particularly on the frontside) according to known techniques.

Dyes useful as antihalation, filter, cross-over prevention (anti-crossover), anti-irradiation and/or acutance dyes include squaraine dyes described in U.S. Pat. No. 5,380,635 (Gomez et al.), U.S. Pat. No. 6,063,560 (Suzuki et al.), and EP 1 083 459 A1 (Kimura), the indolenine dyes described in EP 0 342 810A1 (Leichter), and the cyanine dyes described in U.S. Ser. No. 10/011,892 (filed Dec. 5, 2001 by Hunt, Kong, Ramsden, and LaBelle). All of the above are incorporated herein by reference.

It is also useful in the present invention to employ compositions including acutance, filter, crossover prevention (anti-crossover), anti-irradiation and/or antihalation dyes that will decolorize or bleach with heat during processing. Dyes and constructions employing these types of dyes are described in, for example, U.S. Pat. No. 5,135,842 (Kitchin et al.), U.S. Pat. No. 5,266,452 (Kitchin et al.), U.S. Pat. No. 5,314,795 (Helland et al.), U.S. Pat. No. 6,306,566, (Sakurada et al.), U.S. Published application 2001-0001704 (Sakurada et al.), JP 2001-142175 (Hanyu et al.), and JP 2001-183770 (Hanye et al.). Also useful are bleaching compositions described in JP 11-302550 (Fujiwara), JP 2001-109101 (Adachi), JP 2001-51371 (Yabuki et al.), JP 2001-22027 (Adachi), JP 2000-029168 (Noro), and U.S. Pat. No. 6,376,163 (Goswami, et al.). All of the above are incorporated herein by reference. Particularly useful heat-bleachable acutance, filter, crossover prevention (anti-crossover), anti-irradiation and/or antihalation compositions include a radiation absorbing compound used in combination with a hexaarylbiimidazole (also known as a "HABI"). Such HABI compounds are well known in the art, such as U.S. Pat. No. 4,196,002 (Levinson et al.), U.S. Pat. No. 5,652,091 (Perry et al.), and U.S. Pat. No. 5,672,562 (Perry et al.), all incorporated herein by reference. Examples of such heat-bleachable compositions are described for example in U.S. Pat. No. 6,558,880 (Goswami et al.) and U.S. Pat. No. 6,514,677 (Ramsden et al.), both incorporated herein by reference.

Under practical conditions of use, the compositions are heated to provide bleaching at a temperature of at least 90° C. for at least 0.5 seconds.

Imaging/Development

The photothermographic materials of the present invention can be imaged in any suitable manner consistent with the type of material using any suitable imaging source (typically some type of radiation or electronic signal) to which they are sensitive. The materials can be made sensitive to X-radiation or radiation in the ultraviolet region of the spectrum, the visible region of the spectrum, or the infrared region of the electromagnetic spectrum.

Useful X-radiation imaging sources include general medical, mammographic, dental, industrial X-ray units, and other X-radiation generating equipment known to one skilled in the art. Exposure to visible light can be achieved using conventional spectrophotometers, xenon or tungsten flash lamps, or other incandescent light sources. Exposure to infrared radiation can be achieved using any source of infrared radiation, including: an infrared laser, an infrared laser diode, an infrared light-emitting diode, an infrared lamp, or any other infrared radiation source readily apparent to one skilled in the art, and others described in the art.

Thermal development conditions will vary, depending on the construction used but will typically involve heating the imagewise exposed material at a suitably elevated temperature. Thus, the latent image can be developed by heating the exposed material at a moderately elevated temperature of, for example, from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means such as a hot plate, a steam iron, a hot roller or a heating bath.

Use as a Photomask

The photothermographic materials of the present invention are sufficiently transmissive in the range of from about 350 to about 450 nm in non-imaged areas to allow their use in a method where there is a subsequent exposure of an ultraviolet or short wavelength visible radiation sensitive imageable medium. For example, imaging the photothermographic material and subsequent development affords a visible image. The heat-developed photothermographic material absorbs ultraviolet or short wavelength visible radiation in the areas where there is a visible image and transmits ultraviolet or short wavelength visible radiation where there is no visible image. The heat-developed material may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed photothermographic material provides an image in the imageable material. This method is particularly useful where the imageable medium comprises a printing plate and the photothermographic material serves as an imagesetting film.

Imaging Assemblies

To further increase photospeed, the X-radiation sensitive photothermographic materials of this invention may be used in association with one or more phosphor intensifying screens and/or metal screens in what is known as "imaging assemblies". An intensifying screen absorbs X-radiation and emits longer wavelength electromagnetic radiation that the photosensitive silver halide more readily absorbs. Double-coated X-radiation sensitive photothermographic materials (that is, materials having one or more thermally developable imaging layers on both sides of the support) are preferably used in combination with two intensifying screens, one screen in the "front" and one screen in the "back" of the material.

The imaging assemblies of the present invention are composed of a photothermographic material as defined herein (particularly one sensitive to X-radiation or visible light) and one or more phosphor intensifying screens adjacent the front and/or back of the material. The screens are typically designed to absorb X-rays and to emit electromagnetic radiation having a wavelength greater than 300 nm.

There are a wide variety of phosphors known in the art that can be formulated into phosphor intensifying screens, including but not limited to, the phosphors described in *Research Disclosure*, August 1979, Item 18431, Section IX, X-ray Screens/Phosphors, U.S. Pat. No. 2,303,942 (Wynd et al.), U.S. Pat. No. 3,778,615 (Luckey), U.S. Pat. No. 4,032,471 (Luckey), U.S. Pat. No. 4,225,653 (Brixner et al.), U.S. Pat. No. 3,418,246 (Royce), U.S. Pat. No. 3,428,247 (Yocon), U.S. Pat. No. 3,725,704 (Buchanan et al.), U.S. Pat. No. 2,725,704 (Swindells), U.S. Pat. No. 3,617,743 (Rabatin), U.S. Pat. No. 3,974,389 (Ferri et al.), U.S. Pat. No. 3,591,516 (Rabatin), U.S. Pat. No. 3,607,770 (Rabatin), U.S. Pat. No. 3,666,676 (Rabatin), U.S. Pat. No. 3,795,814 (Rabatin), U.S. Pat. No. 4,405,691 (Yale), U.S. Pat. No. 4,311,487 (Luckey et al.), U.S. Pat. No. 4,387,141 (Patten), U.S. Pat. No. 5,021,327 (Bunch et al.), U.S. Pat. No. 4,865,944 (Roberts et al.), U.S. Pat. No. 4,994,355 (Dickerson et al.), U.S. Pat. No. 4,997,750 (Dickerson et al.), U.S. Pat. No. 5,064,729 (Zegarski), U.S. Pat. No. 5,108,881 (Dickerson et al.), U.S. Pat. No. 5,250,366 (Nakajima et al.), U.S. Pat. No. 5,871,892 (Dickerson et al.), EP-A-0 491,116 (Benzo et al.), U.S. Pat. No. 4,988,880 (Bryan et al.), U.S. Pat. No. 4,988,881 (Bryan et al.), U.S. Pat. No. 4,994,205 (Bryan et al.), U.S. Pat. No. 5,095,218 (Bryan et al.), U.S. Pat. No. 5,112,700 (Lambert et al.), U.S. Pat. No. 5,124,072 (Dole et al.), U.S. Pat. No. 5,336,893 (Smith et al.), U.S. Pat. No. 4,835,397 (Arakawa et al.), U.S. Pat. No. 5,381,015 (Dooms), U.S. Pat. No. 5,464,568 (Bringley et al.), U.S. Pat. No. 4,226,653 (Brixner), U.S. Pat. No. 5,064,729 (Zegarski), U.S. Pat. No. 5,250,366 (Nakajima et al.), and U.S. Pat. No. 5,626,957 (Benso et al.), U.S. Pat. No. 4,368,390 (Takahashi et al.), U.S. Pat. No. 5,227,253 (Takasu et al.), the disclosures of which are all incorporated herein by reference for their teaching of phosphors and formulation of phosphor intensifying screens.

Phosphor intensifying screens can take any convenient form providing they meet all of the usual requirements for use in radiographic imaging, as described for example in U.S. Pat. No. 5,021,327 (Bunch et al.), incorporated herein by reference. A variety of such screens are commercially available from several sources including by not limited to, LANEX®, X-SIGHT® and InSight® Skeletal screens all available from Eastman Kodak Company. The front and back screens can be appropriately chosen depending upon the type of emissions desired, the desired photicity, emulsion speeds, and % crossover. A metal (such as copper or lead) screen can also be included if desired.

Imaging assemblies can be prepared by arranging a suitable photothermographic material in association with one or more phosphor intensifying screens, and one or more metal screens in a suitable holder (often known as a cassette), and appropriately packaging them for transport and imaging uses.

Constructions and assemblies useful in industrial radiography include, for example, U.S. Pat. No. 4,480,024 (Lyons et al), U.S. Pat. No. 5,900,357 (Feumi-Jantou et al.), and EP 1 350 883A1 (Pesce et al.).

MATERIALS AND METHODS FOR THE EXAMPLES

All materials used in the following examples are readily available from standard commercial sources, such as Aldrich Chemical Co. (Milwaukee Wis.) unless otherwise specified. All percentages are by weight unless otherwise indicated. The following additional terms and materials were used.

"MBTI" is 3-methylbenzothiazolium iodide.

"DMU" is 1,3-dimethylurea.

"SU" is succinimide.

Vinyl Sulfone-A (VS-A) is 1,1'-[methylenebis(sulfonyl)] bis-ethene. It has the following structure:

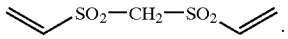

Sensitizing Dye A is

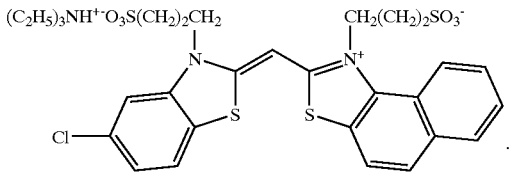

Compound C-2 is

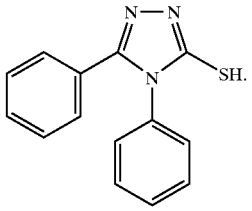

The following examples are provided to illustrate the practice of the present invention and the invention is not meant to be limited thereby.

Example 1

Preparation of Aqueous-Based Photothermoeraphic Materials

Aqueous-based photothermographic materials of this invention were prepared in the following manner.

Preparation of Silver Salt Dispersion

A stirred reaction vessel was charged with 85 g of lime processed gelatin, 25 g of phthalated gelatin, and 2 liters of deionized water (Solution A). Solution B containing 185 g of benzotriazole, 1405 ml of deionized water, and 680 g of 2.5 molar sodium hydroxide was prepared. The reaction vessel solution was adjusted to pAg 7.25 and a pH of 8.0 by addition of Solution B and 2.5M sodium hydroxide solution as needed, and maintained at a temperature of 36° C.

Solution C containing 228.5 g of silver nitrate and 1222 ml of deionized water was added to the reaction vessel at the accelerated flow rate of Flow=16(1+0.002t$^2$) ml/min wherein "t" is time, and the pAg was maintained at 7.25 by a simultaneous addition of Solution B. This process was terminated when Solution C was exhausted, at which point Solution D of 80 g of phthalated gelatin and 700 ml of deionized water at 40° C. was added to the reaction vessel. The resulting solution in the reaction vessel was stirred and its pH was adjusted to 2.5 with 2 molar sulfuric acid to coagulate the silver salt emulsion. The coagulum was washed twice with 5 liters of deionized water and redispersed by adjusting the pH to 6.0 and vAg to 7.0 with 2.5M sodium hydroxide solution and Solution B. The resulting silver salt dispersion contained fine particles of silver benzotriazole salt.

Preparation of Cubic Silver Bromoiodide Emulsion

A reaction vessel equipped with a stirrer was charged with 75 g of phthalated gelatin, 1650 g of deionized water, 40 ml of 0.2M KBr solution, an antifoamant and sufficient nitric acid to adjust pH to 5.0, at 53° C. A small amount of AgBrI emulsion grains (0.12 μm, 0.035 mol, 6%I, cubic) were added as seed crystals. Solution A and solution B were added simultaneously while pAg and temperature of the reactor was held constant.

Solution A was prepared at 25° C. as follows:

| | |
|---|---|
| $AgNO_3$ | 743 g |
| deionized water | 1794 g |

Solution B was prepared at 25° C. as follows:

| | |
|---|---|
| KBr | 559 g |
| KI | 50 g |
| deionized Water | 1900 g |

The addition rates of solution A and solution B started at 14 ml/min, then accelerated as a function of total reaction time according to the equation:

$$\text{Flow Rate}=14(1+0.028t^2)\text{ml/min, where t is the time in minutes.}$$

The reaction was terminated when all solution A was consumed. The emulsion was coagulation washed and adjusted pH to 5.5 to give 4.3 mol of control emulsion A. The average grain size was 0.25 μm as determined by Scanning Electron Microscopy (SEM).

Preparation of Tabular Grain Photosensitive Silver Halide Emulsion

A vessel equipped with a stirrer was charged with 6 liters of water containing 4.21 g lime-processed bone gelatin, 4.63 g NaBr, 37.65 mg KI, an antifoamant, and 1.25 ml of 0.1M sulfuric acid. It was then held at 39° C. for 5 minutes. Simultaneous additions were then made of 5.96 ml of 2.5378M $AgNO_3$ and 5.96 ml of 2.5M NaBr over 4 seconds. Following nucleation, 0.745 ml of a 4.69% solution of NaOCl was added. The temperature was increased to 54° C. over 9 minutes. After a 5-minute hold, 100 g of oxidized methionine lime-processed bone gelatin in 1.412 liters of water containing additional antifoamant at 54° C. were then added to the reactor. The reactor temperature was held for 7 minutes, after which 106 ml of 5M NaCl containing 2.103 g of NaSCN was added. The reaction was held for 1 minute.

During the next 38 minutes the first growth stage took place wherein solutions of 0.6M $AgNO_3$, 0.6M NaBr, and a 0.29M suspension of AgI (Lippmann) were added to maintain a nominal uniform iodide level of 4.2 mole %. The flow rates during this growth segment were ramped from 9 to 42 ml/min ($AgNO_3$) and from 0.8 to 3.7 ml/min (AgI). The flow rates of the NaBr were allowed to fluctuate as needed to maintain a constant pBr. At the end of this growth segment 78.8 ml of 3.0M NaBr were added and held for 3.6 minutes.

During the next 75 minutes the second growth stage took place wherein solutions of 3.5M $AgNO_3$ and 4.0M NaBr and a 0.29M suspension of AgI (Lippmann) were added to maintain a nominal iodide level of 4.2 mole %. The flow rates during this segment were ramped from 8.6 to 30 ml/min ($AgNO_3$) and from 4.5 to 15.6 ml/min (AgI). The flow rates of the NaBr were allowed to fluctuate as needed to maintain a constant pBr.

During the next 15.8 minutes the third growth stage took place wherein solutions of 3.5M $AgNO_3$ and 4.0M NaBr and a 0.29M suspension of AgI (Lippmann) were added to maintain a nominal iodide level of 4.2 mole %. The flow rates during this segment were 35 ml/min ($AgNO_3$) and 15.6 ml/min (AgI). The temperature was ramped downward to 47.8° C. during this segment. A 1.5 ml solution containing 0.06 mg of potassium tetrachloroiridate ($KIrCl_4$) was then added below the reactor surface and held for 5 seconds.

During the next 32.9 minutes the fourth growth stage took place wherein solutions of 3.5M $AgNO_3$ and 4.0M NaBr and a 0.29M suspension of AgI (Lippmann) were added to maintain a nominal iodide level of 4.2 mole %. The flow rates during this segment were held constant at 35 ml/min ($AgNO_3$) and 15.6 ml/min (AgI). The temperature was ramped downward to 35° C. during this segment.

A total of 12 moles of silver iodobromide (4.2% bulk iodide) were formed. The resulting emulsion was coagulated using 430.7 g phthalated lime-processed bone gelatin and washed with de-ionized water. Lime-processed bone gelatin (269.3 g) was added along with a biocide and pH and pBr were adjusted to 6 and 2.5 respectively.

The resulting emulsion was examined by Scanning Electron Microscopy. Tabular grains accounted for greater than 99% of the total projected area. The mean ECD of the grains was 2.369 μm. The mean tabular thickness was 0.062 μm.

Preparation of Toner Dispersion

A mixture containing 4 g of mercaptotriazole toner (see TABLE III below), 16 g of 10% poly(vinyl pyrrolidone) solution, and 18 ml of deionized water were ball milled with a Brinkmann Instrument S100 grinder for three hours. To the resulting suspension were added 15 g of a 30% lime processed gelatin solution and the mixture was heated to 50° C. on a water bath to give a fine dispersion of mercaptotriazole particles in gelatin.

Preparation of Photothermographic Formulations

Photothermographic formulations were prepared using the components shown in TABLE I or in TABLE II below. The formulations were coated as a single layer on a 7 mil (178 μm) transparent, blue-tinted poly(ethylene terephthalate) film support.

TABLE I

Photothermographic Emulsion Prepared from Cubic Silver Halide Grains

| Component | Coating Weight ($g/m^2$) |
|---|---|
| Silver (from Ag benzotriazole salt) | 1.8 |
| Silver (from AgBr emulsion) | 0.4 |
| Sodium benzotriazole | 0.14 |
| MBTI | 0.09 |
| Succinimide (SU) | 0.36 |
| 1,3-Dimethylurea (DMU) | 0.36 |
| Toner compound | see Table III |
| Ascorbic acid | 1.14 |
| Lime processed gelatin | 0.5–1.25 |

TABLE II

Photothermographic Emulsion Prepared from Tabular Silver Halide Grains

| Component | Coating Weight ($g/m^2$) |
|---|---|
| Silver (from Ag benzotriazole salt) | 2.27 |
| Silver (from AgBr emulsion) | 0.4 |
| Sodium benzotriazole | 0.13 |

TABLE II-continued

| Photothermographic Emulsion Prepared from Tabular Silver Halide Grains | |
|---|---|
| Component | Coating Weight (g/m$^2$) |
| Succinimide (SU) | 0.14 |
| 1,3-Dimethylurea (DMU) | 0.10 |
| Phthalazine | 0.13 |
| MBTI | 0.09 |
| VS-A | 0.07 |
| Toner compound | see Table III |
| Ascorbic acid | 2.01 |
| Lime processed gelatin | 0.5–1.25 |

The resulting photothermographic films were imagewise exposed for $10^{-3}$ seconds using an EG&G flash sensitometer equipped with a P-16 filter and a 0.7 neutral density filter. Following exposure, the films were thermally processed using a heated rotating drum for 15 or 25 seconds at 150° C.

Samples were evaluated for tone using the scale shown below. A warm black tone is preferred Tone:

4=warm black

3=brown-black,

2=brown,

1=faint.

"Relative Speed" was determined at a density value of 0.25 above $D_{min}$. Values were normalized with Sample 1–80 assigned a speed of 100.

The sensitometric results and evaluations of each photothermographic film are shown below in TABLE III.

TABLE III

| Sample | Toner | Amount of Toner | Emulsion | $D_{min}$ | $D_{max}$ | Relative Speed | Thermal Solvent | Tone | Invention or Comparison |
|---|---|---|---|---|---|---|---|---|---|
| 1-6 | T-28 | 0.048 | Table II | 0.36 | 2.30 | 122 | DMU/SU | 4 | INVENTION |
| 1-9 | T-42 | 0.171 | Table I | 0.41 | 1.64 | 129 | DMU/SU | 4 | Invention |
| 1-10 | T-43 | 0.045 | Table I | 0.39 | 1.39 | 145 | DMU/SU | 4 | Invention |
| 1-11 | T-49 | 0.10 | Table I | 0.37 | 2.63 | 136 | DMU/SU | 4 | Invention |
| 1-12 | T-50 | 0.083 | Table I | 0.36 | 2.78 | 139 | DMU/SU | 4 | Invention |
| 1-13 | T-19 | 0.075 | Table I | 0.39 | 3.17 | 139 | DMU/SU | 4 | Invention |
| 1-14 | T-19 | 0.075 | Table I | 0.37 | 3.16 | 143 | DMU/SU | 4 | Invention |
| 1-15 | T-51 | 0.97 | Table I | 0.37 | 1.91 | 126 | DMU/SU | 4 | Invention |
| 1-16 | T-21 | 0.86 | Table I | 0.40 | 2.10 | 133 | DMU/SU | 4 | Invention |
| 1-17 | T-52 | 0.86 | Table I | 0.38 | 3.17 | 140 | DMU/SU | 4 | Invention |
| 1-18 | T-52 | 0.058 | Table II | 0.34 | 0.91 | 119 | DMU/SU | 4 | Invention |
| 1-19 | T-22 | 0.101 | Table I | 0.38 | 3.18 | 140 | DMU/SU | 4 | Invention |
| 1-20 | T-54 | 0.088 | Table I | 0.39 | 2.92 | 140 | DMU/SU | 4 | Invention |
| 1-22 | T-16 | 0.072 | Table II | 0.37 | 2.05 | 161 | DMU/SU | 4 | Invention |
| 1-23 | T-6 | 0.109 | Table I | 0.41 | 3.16 | 143 | DMU/SU | 4 | Invention |
| 1-26 | T-15 | 0.219 | Table I | 0.39 | 2.04 | 143 | DMU/SU | 4 | Invention |
| 1-30 | T-25 | 0.098 | Table I | 0.43 | 2.09 | 144 | DMU/SU | 4 | Invention |
| 1-31 | T-17 | 0.093 | Table I | 0.42 | 2.19 | 147 | DMU/SU | 4 | Invention |
| 1-32 | T-23 | 0.093 | Table I | 0.39 | 2.34 | 141 | DMU/SU | 4 | Invention |
| 1-34 | T-4 | 0.081 | Table I | 0.38 | 2.52 | 145 | DMU/SU | 4 | Invention |
| 1-35 | T-6 | 0.081 | Table I | 0.41 | 2.52 | 149 | DMU/SU | 4 | Invention |
| 1-36 | T-7 | 0.082 | Table I | 0.43 | 2.50 | 155 | DMU/SU | 4 | Invention |
| 1-37 | T-11 | 0.086 | Table I | 0.42 | 2.49 | 151 | DMU/SU | 4 | Invention |
| 1-38 | T-32 | 0.095 | Table I | 0.40 | 1.75 | 132 | DMU/SU | 4 | Invention |
| 1-39 | T-18 | 0.093 | Table I | 0.33 | 1.91 | 140 | DMU/SU | 4 | Invention |
| 1-41 | T-27 | 0.078 | Table I | 0.35 | 2.70 | 143 | DMU/SU | 4 | Invention |
| 1-42 | T-27 | 0.078 | Table I | 0.33 | 1.78 | 113 | none | 4 | Invention |
| 1-43 | T-8 | 0.102 | Table I | 0.34 | 2.01 | 135 | DMU/SU | 4 | Invention |
| 1-44 | T-10 | 0.102 | Table I | 0.35 | 1.45 | 126 | DMU/SU | 4 | Invention |
| 1-45 | T-55 | 0.089 | Table I | 0.37 | 2.42 | 138 | DMU/SU | 4 | Invention |
| 1-46 | T-9 | 0.089 | Table I | 0.34 | 2.29 | 139 | DMU/SU | 4 | Invention |
| 1-47 | T-9 | 0.094 | Table II | 0.28 | 2.41 | 117 | DMU/SU | 4 | Invention |
| 1-48 | T-5 | 0.089 | Table I | 0.37 | 2.42 | 145 | DMU/SU | 4 | Invention |
| 1-49 | T-5 | 0.094 | Table II | 0.34 | 2.91 | 122 | DMU/SU | 4 | Invention |
| 1-50 | T-35 | 0.086 | Table I | 0.35 | 1.90 | 136 | DMU/SU | 4 | Invention |
| 1-51 | T-12 | 0.075 | Table I | 0.43 | 1.84 | 154 | DMU/SU | 4 | Invention |
| 1-52 | T-12 | 0.075 | Table I | 0.35 | 0.96 | 114 | none | 4 | Invention |
| 1-53 | T-29 | 0.066 | Table I | 0.30 | 2.35 | 135 | DMU/SU | 4 | Invention |
| 1-54 | T-34 | 0.062 | Table I | 0.39 | 2.62 | 132 | DMU/SU | 4* | Invention |
| 1-55 | T-33 | 0.098 | Table I | 0.35 | 1.44 | 127 | DMU/SU | 4* | Invention |
| 1-56 | T-1 | 0.050 | Table II | 0.41 | 2.23 | 169 | DMU/SU | 4 | Invention |
| 1-57 | T-1 | 0.075 | Table I | 0.45 | 3.17 | 150 | Meso-erythritol/SU | 3 | Invention |
| 1-58 | T-1 | 0.075 | Table I | 0.39 | 2.90 | 145 | D-Sorbitol/SU | 3 | Invention |
| 1-59[a] | T-1 | 0.075 | Table I | 0.37 | 2.79 | 145 | DMU/SU | 4 | Invention |
| 1-60 | T-1 | 0.075 | Table I | 0.36 | 2.78 | 143 | Tetrahydro-2-Pyrimidone/SU | 4 | Invention |
| 1-61 | T-1 | 0.075 | Table I | 0.38 | 2.96 | 143 | 1,3-Diethylurea/SU | 3 | Invention |
| 1-62 | T-1 | 0.075 | Table I | 0.36 | 2.57 | 143 | 2-Imidazolidone/SU | 4 | Invention |
| 1-63 | T-1 | 0.075 | Table I | 0.40 | 2.62 | 142 | 2-Imidazolidone- | 4 | Invention |

TABLE III-continued

| Sample | Toner | Amount of Toner | Emulsion | $D_{min}$ | $D_{max}$ | Relative Speed | Thermal Solvent | Tone | Invention or Comparison |
|---|---|---|---|---|---|---|---|---|---|
| | | | | | | | 4-Carboxylic Acid/SU | | |
| 1-64 | T-1 | 0.075 | Table I | 0.36 | 3.08 | 140 | D-Sorbitol | 4 | Invention |
| 1-65 | T-1 | 0.075 | Table I | 0.30 | 2.69 | 138 | Niacinamide | 4 | Invention |
| 1-66 | T-1 | 0.075 | Table I | 0.30 | 2.69 | 138 | none | 4 | Invention |
| 1-67 | T-1 | 0.075 | Table I | 0.31 | 1.81 | 137 | Hydantoin/SU | 4 | Invention |
| 1-68 | T-1 | 0.079 | Table II | 0.43 | 3.06 | 134 | DMU/SU | 4 | Invention |
| 1-69 | T-1 | 0.075 | Table I | 0.33 | 1.86 | 134 | none | 4 | Invention |
| 1-70 | T-1 | 0.075 | Table I | 0.33 | 2.05 | 134 | 5,5-Dimethylhydantoin/ SU | 4 | Invention |
| 1-71 | T-1 | 0.075 | Table I | 0.36 | 1.66 | 130 | 1,3-Diallylurea/ SU | 4 | Invention |
| 1-72 | T-1 | 0.075 | Table I | 0.36 | 1.11 | 113 | Glycoluril/SU | 4 | Invention |
| 1-73[b] | T-2 | 0.182 | Table I | 0.42 | 2.40 | 147 | DMU/SU | 4 | Invention |
| 1-74 | T-2 | 0.182 | Table I | 0.387 | 1.051 | 104 | none | 4 | Invention |
| 1-75 | T-3 | 0.126 | Table I | 0.47 | 2.71 | 153 | DMU/SU | 4 | Invention |
| 1-76[c] | T-3 | 0.070 | Table I | 0.38 | 2.86 | 146 | DMU/SU | 4 | Invention |
| 1-77 | T-3 | 0.070 | Table I | 0.33 | 2.77 | 142 | Niacinamide | 4 | Invention |
| 1-78 | T-3 | 0.073 | Table II | 0.38 | 3.33 | 135 | DMU/SU | 4 | Invention |
| 1-79 | T-3 | 0.070 | Table I | 0.32 | 1.38 | 110 | none | 4 | Invention |
| 1-80 | C-2 | 0.100 | Table I | 0.36 | 0.85 | 100 | DMU/SU | 1 | Comparative |
| 1-83 | T-36 | 0.059 | Table I | 0.37 | 3.00 | 134 | DMU/SU | 4 | Invention |
| 1-84 | T-36 | 0.040 | Table II | 0.32 | 0.95 | 130 | DMU/SU | 4 | Invention |
| 1-85 | T-58 | 0.057 | Table I | 0.47 | 1.70 | 132 | DMU/SU | 4 | Invention |
| 1-86 | T-59 | 0.081 | Table I | 0.38 | 2.40 | 139 | DMU/SU | 4 | Invention |
| 1-87 | T-56 | 0.090 | Table I | 0.35 | 1.48 | 123 | DMU/SU | 4 | Invention |
| 1-88 | T-41 | 0.041 | Table II | 0.35 | 2.17 | 151 | DMU/SU | 4 | Invention |
| 1-89 | T-41 | 0.062 | Table I | 0.36 | 2.72 | 139 | DMU/SU | 4 | Invention |
| 1-91[d] | T-57 | 0.036 | Table I | 0.47 | 1.66 | 151 | DMU/SU | 4 | Invention |
| 1-98 | T-37 | 0.068 | Table I | 0.47 | 2.47 | 156 | DMU/SU | 4 | Invention |
| 1-99 | T-44 | 0.051 | Table I | 0.33 | 1.37 | 133 | DMU/SU | 4 | Invention |

[a]Average of 26 coatings
[b]Average of 15 Coatings
[c]Average of 4 Coatings
[d]Sample contained 0.71 g/m$^2$ of ascorbic acid and was processed at 145° C.

Example 2

Photothermopraphic Materials with Various Antifoggants

This example demonstrates the reduction of fog after thermal processing achieved by the incorporation of various benzothiazolium salts according to the present invention, with MBTI being the most preferred antifoggant.

Photothermographic materials were prepared using the components shown in TABLE IV below. The formulations were coated and dried as described in Example 1. Comparative Sample 2-1 contained no antifoggant, Comparative Sample 2-2 contained sodium iodide as the antifoggant.

TABLE IV

| Photothermographic Material Prepared from Tabular Silver Halide Grains | |
|---|---|
| Component | Coating Weight (g/m$^2$) |
| Silver (from Ag benzotriazole salt) | 1.63 |
| Silver (from AgBr emulsion) | 0.4 |
| Sodium benzotriazole | 0.09 |
| Succinimide (SU) | 0.12 |
| 1,3-Dimethylurea (DMU) | 0.15 |
| Carboxyethyl-phthalazinium chloride | 0.06 |
| Antifoggant Compound | See TABLE V |
| VS-A | 0.09 |
| Toner Compound T-1 | 0.05 |
| Ascorbic acid | 1.72 |
| Lime processed gelatin | 1.89 |

Sensitometry measurements were made on a custom built computer-scanned sensitometer and are believed to be comparable to measurements from commercially available sensitometers. The photothermographic materials were exposed for 1/50$^{th}$ second through a 0–3 graduated density 21 step tablet. The light source was a General Electric Quartzline 750 watt tungsten lamp tuned to 2850 K color temperature and filtered with blue glass and 1.0 neutral density filters to simulate a blue light-emitting fluorescent intensifying screen. The exposed materials were thermally developed as described in Example 1 except that thermal development was carried out for 23 seconds. The various antifoggants, amounts (g/m$^2$), and results are shown in the following TABLE V.

$D_{min}$ and $D_{max}$ results were obtained using conventional techniques. "Relative Speed" was determined at a density of 1.0 above $D_{min}$. The values were normalized with Sample 2-1 assigned a Relative Speed of 100.

The data, shown below in TABLE V, demonstrate that the addition of the various benzothiazolium salts to the photothermographic materials reduces fog ($D_{min}$) after thermal processing compared to the use of conventional antifoggants in the Comparative photothermographic materials. A reduction in fog and an unexpected increase in photospeed were achieved in Sample 2-3, the sample that included 3-methylbenzothiazolium iodide (MBTI) as the antifoggant.

TABLE V

| Sample | Control Compound | BZ Compound | Amount (g/m$^2$) | $D_{min}$ | $D_{max}$ | Relative Speed | Invention or Comparison |
|---|---|---|---|---|---|---|---|
| 2-1 | None | None | 0 | 0.70 | 1.85 | 100 | Control |
| 2-2 | NaI | None | 0.04 | 0.83 | 1.72 | 59 | Comparison |
| 2-3 | None | BZ-1 | 0.08 | 0.32 | 2.20 | 186 | Invention |
| 2-4 | None | BZ-4 | 0.09 | 0.30 | 1.51 | 85 | Invention |

TABLE V-continued

| Sample | Control Compound | BZ Compound | Amount ($g/m^2$) | $D_{min}$ | $D_{max}$ | Relative Speed | Invention or Comparison |
|---|---|---|---|---|---|---|---|
| 2-5 | None | BZ-5 | 0.09 | 0.28 | 0.97 | NA | Invention |
| 2-6 | None | BZ-6 | 0.10 | 0.28 | 0.56 | NA | Invention |
| 2-7 | None | BZ-7 | 0.09 | 0.28 | 0.85 | NA | Invention |
| 2-8 | None | BZ-8 | 0.10 | 0.31 | 1.12 | 47 | Invention |
| 2-9 | None | BZ-9 | 0.10 | 0.27 | 0.50 | NA | Invention |

"NA" = density too low to determine speed at 1.0 above Dmin,

Example 3

Evaluation of Printout Stability

Several photothermographic materials of the present invention were prepared using the components shown in TABLE VI below. The formulations were coated, imaged, and thermally processed as described in Example 2.

TABLE VI

Photothermographic Material Prepared from Tabular Silver Halide Grains

| Component | Coating Weight ($g/m^2$) |
|---|---|
| Silver (from Ag benzotriazole salt) | 1.66 |
| Silver (from AgBr emulsion) | 0.34 |
| Sodium benzotriazole | 0.08 |
| Succinimide (SU) | 0.13 |
| 1,3-Dimethylurea (DMU) | 0.17 |
| Carboxyethyl-phthalazinium chloride | 0.07 |
| Antifoggant Compound | See TABLE VII |
| VS-A | 0.07 |
| Toner Compound T-1 | 0.07 |
| Ascorbic acid | 1.94 |
| Lime processed gelatin | 2.06 |

$D_{min}$, $D_{max}$, and Relative Speed values were measured as described in Example 2 with Sample 3-1 being assigned Relative Speed 100. The $\Delta D_{min}$ was an evaluation of the change in $D_{min}$ after exposure to a ceiling mounted fluorescent light for 24 hours at 21° C. and 80% Relative Humidity, as a measure of post-processing light printout stability. The results are shown in the following TABLE VII.

The results, shown below in TABLE VII, demonstrate that the choice of anion in the antifoggant may affect the post-processing stability of the image in the photothermographic material. The presence of iodide ion appears to be preferred in the benzothiazolium compounds, but other ions may be preferable for different antifoggants.

TABLE VII

| Sample | BZ Compound | Amount ($g/m^2$) | $D_{min}$ | $D_{max}$ | Relative Speed | $\Delta D_{min}$ | Invention or Comparison |
|---|---|---|---|---|---|---|---|
| 3-1 | BZ-1 | 0.08 | 0.36 | 2.30 | 100 | +0.54 | Invention |
| 3-2 | BZ-2 | 0.07 | 0.30 | 1.22 | 19.5 | +1.91 | Invention |
| 3-3 | BZ-3 | 0.06 | 0.28 | 0.78 | NA | +1.51 | Invention |
| 3-4 | BZ-4 | 0.10 | 0.28 | 1.46 | 26.5 | +0.95 | Invention |

"NA" = density too low to determine speed at 1.0 above $D_{min}$

The invention has been described in detail with particular reference to certain preferred embodiments thereof, but it will be understood that variations and modifications can be effected within the spirit and scope of the invention.

We claim:

1. A black-and-white aqueous-based photothermographic material that comprises a support having thereon one or more thermally-developable imaging layers comprising a hydrophilic binder and in reactive association, a preformed photosensitive silver halide, a non-photosensitive source of reducible silver ions that includes an organic silver salt, and a reducing agent composition for said non-photosensitive source reducible silver ions, and in one or more of said thermally developable imaging layers, a benzothiazolium, benzoselenazolium, or benzotellurazolium salt as an antifoggant.

2. The photothermographic material of claim 1 wherein said antifoggant is represented by the following Structure I:

(I)

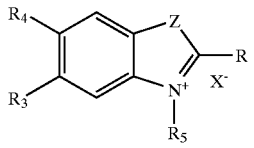

wherein R is hydrogen, an alkyl group having 1 to 5 carbon atoms, or an alkenyl or alkynyl group having 2 to 5 carbon atoms, $R_3$ and $R_4$ are independently hydrogen, halo, cyano, nitro, an alkyl group having 1 to 5 carbon atoms, an alkoxy or alkylthio group having 1 to 5 carbon atoms, an alkenyl or alkynyl group having 2 to 5 carbon atoms, or a benzyl group, or $R_3$ and $R_4$ together can combine to form a saturated or unsaturated fused ring, $R_5$ is a cyclic or acyclic organic group having 1 to 10 carbon, nitrogen, or oxygen atoms, or is an aliphatic linking group having 1 to 12 atoms in the chain and terminating in a benzothiazolium, benzoselenazolium, or benzotellurazolium ion, Z is a sulfur, selenium, or tellurium atom, and $X^-$ is an anion.

3. The photothermographic material of claim 2 wherein Z is a sulfur atom.

4. The photothermographic material of claim 2 wherein R is hydrogen or an alkyl group having 1 to 3 carbon atoms, and $R_3$ and $R_4$ are independently hydrogen, chloro, or an alkoxy group having 1 or 2 carbon atoms, and $R_5$ is an alkyl or alkenyl group having 1 to 3 carbon atoms.

5. The photothermographic material of claim 2 wherein $X^-$ is a halide, tetrafluoroborate, hexafluorophosphate, p-toluenesulfonate, trifluoromethanesulfonate, or perchlorate anion.

6. The photothermographic material of claim 1 comprising one or more of:

(BZ-1)

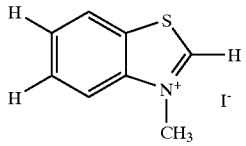

(BZ-2)

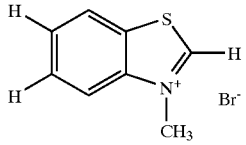

(BZ-3)

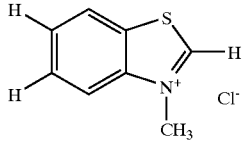

-continued
(BZ-4)
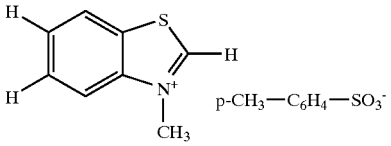
(BZ-5)
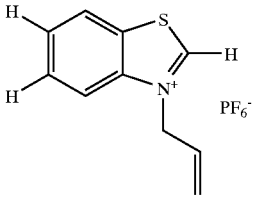
(BZ-6)
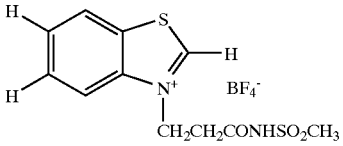
(BZ-7)
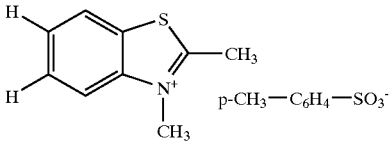
(BZ-8)
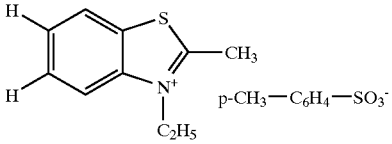
(BZ-9)
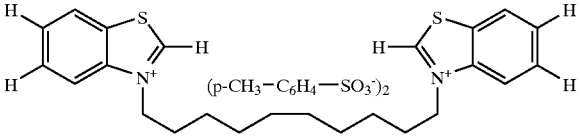
(BZ-10)
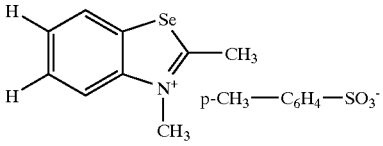
(BZ-11)
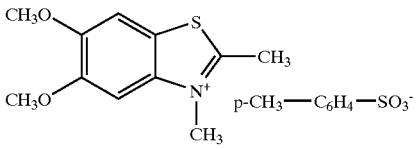
(BZ-12)
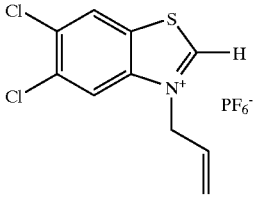
-continued
(BZ-13)
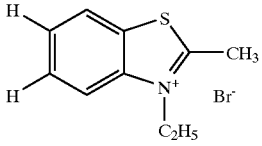
(BZ-14)
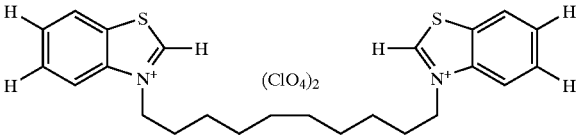
(BZ-15)
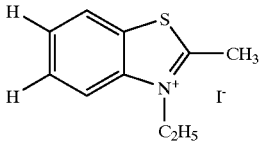
(BZ-16)
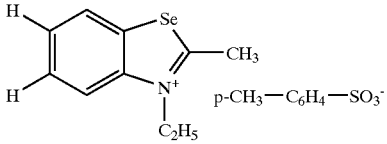
(BZ-17)
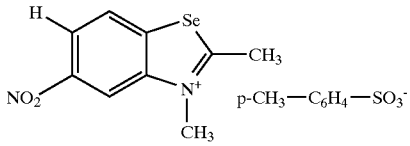
(BZ-18)
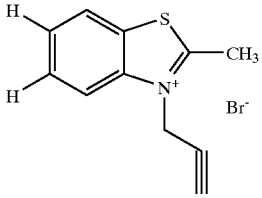
(BZ-19)
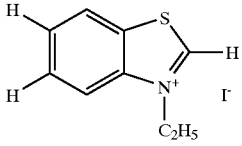
(BZ-20)
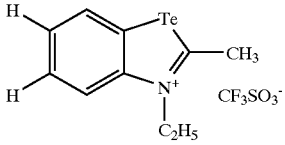
(BZ-21)
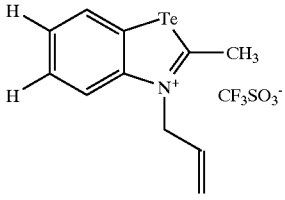

-continued (BZ-22)

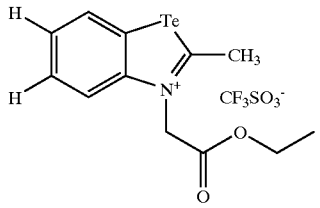

(BZ-23)

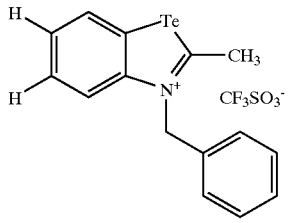

(BZ-24)

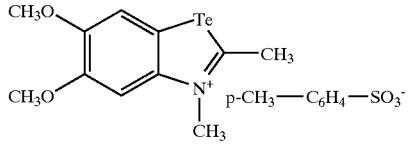

and (BZ-25)

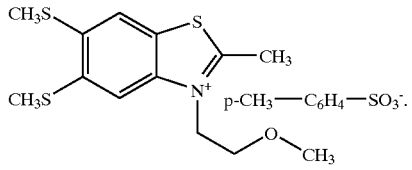

7. The photothermographic material of claim 1 comprising one or more of:

(BZ-1)

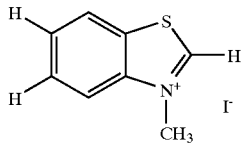

(BZ-4)

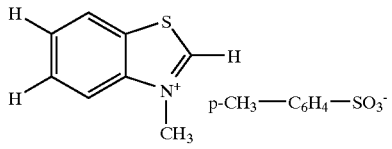

(BZ-5)

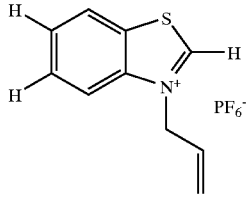

-continued (BZ-6)

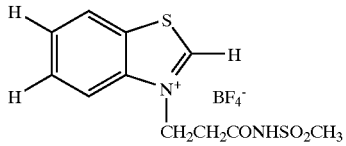

(BZ-7)

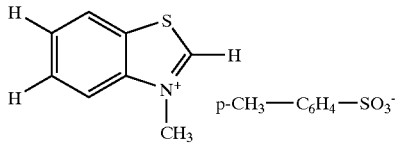

(BZ-8)

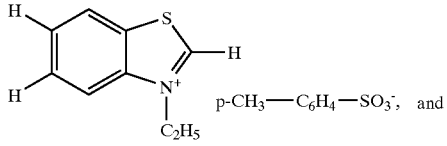

and (BZ-9)

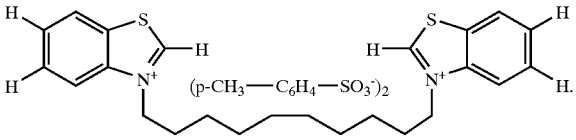

8. The photothermographic material of claim 1 wherein said antifoggant is present in an amount of at least 5 mmol/mol of total silver.

9. The photothermographic material of claim 1 wherein said antifoggant is present in an amount of from about 5 to about 25 mmol/mol of total silver.

10. The photothermographic material of claim 1 further comprising a mercaptotriazole represented by the following Structure II as a toner:

(II)

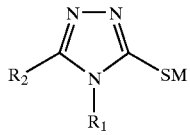

wherein $R_1$ and $R_2$ independently represent hydrogen, a substituted or unsubstituted alkyl group of from 1 to 7 carbon atom, a substituted or unsubstituted alkenyl group having 2 to 5 carbon atoms in the chain, a substituted or unsubstituted cycloalkyl group having 5 to 7 carbon atoms forming the ring, a substituted or unsubstituted aromatic or non-aromatic heterocyclyl group having 5 to 6 carbon, nitrogen, oxygen, or sulfur atoms forming the aromatic or non-aromatic ring, an amino or amide group, a substituted or unsubstituted aryl group having 6 to 10 carbon atoms forming the aromatic ring, or a substituted or unsubstituted $Y_1$—$(CH_2)_k$— group wherein $Y_1$ is a substituted or unsubstituted aryl group having 6 to 10 carbon atoms in the aromatic ring, or a substituted or unsubstituted aromatic or non-aromatic heterocyclyl group as defined above for $R_1$, and k is 1 to 3, or $R_1$ and $R_2$ taken together can form a substituted or unsubstituted, saturated or unsaturated 5- to 7-membered aromatic or non-aromatic nitrogen-containing heterocyclic ring comprising carbon, nitrogen, oxygen, or sulfur atoms in the ring, or still again, $R_1$ or $R_2$ can represent a divalent linking group linking two mercaptotriazole groups, and $R_2$ may further represent carboxy or its salts, and M is hydrogen or a monovalent cation, provided that:

1) $R_1$ and $R_2$ are not simultaneously hydrogen,
2) when $R_1$ is substituted or unsubstituted phenyl or benzyl, $R_2$ is not substituted or unsubstituted phenyl or benzyl,
3) when $R_2$ is hydrogen, $R_1$ is not an allenyl, 2,2-diphenylethyl, α-methylbenzyl, or a phenyl group having a cyano or a sulfonic acid substituent,
4) when $R_1$ is an unsubstituted benzyl or phenyl group, $R_2$ is not substituted 1,2-dihydroxyethyl, or 2-hydroxy-2-propyl, and
5) when $R_1$ is hydrogen, $R_2$ is not 3-phenylthiopropyl.

11. The photothermographic material of claim 1 wherein said one or more thermally developable imaging layers has a pH less than 7.

12. The photothermographic material of claim 11 wherein said one or more thermally developable imaging layers has a pH less than 6.

13. The photothermographic material of claim 1 wherein said non-photosensitive source of reducible silver ions is a silver salt of a compound containing an imino group.

14. The photothermographic material of claim 13 wherein said non-photosensitive source of reducible silver ions is a silver salt of benzotriazole or a substituted derivatives thereof, or mixtures of such silver salts.

15. The photothermographic material of claim 14 wherein said non-photosensitive source of reducible silver ions excludes a silver salt of a carboxylate.

16. The photothermographic material of claim 1 wherein said photosensitive silver halide comprises one or more preformed silver halide having either cubic, tabular, or both cubic and tabular morphologies.

17. The photothermographic material of claim 1 wherein said reducing agent composition comprises an ascorbic acid.

18. The photothermographic material of claim 1 wherein said hydrophilic binder is a gelatin, gelatin derivative, polyvinyl alcohol, or cellulosic material.

19. The photothermographic material of claim 1 further comprising one or more thermally developable imaging layers on the backside of said support.

20. The photothermographic material of claim 1 further comprising one or more acutance dyes in said one or more thermally developable imaging layers.

21. The photothermographic material of claim 1 further comprising one or more phosphors in said one or more thermally developable imaging layers.

22. A black-and-white photothermographic material that comprises a transparent support having thereon one or more thermally developable imaging layers comprising a hydrophilic binder that is gelatin or a gelatin derivative, and in reactive association, a preformed photosensitive silver bromide or silver iodobromide present as tabular grains, a non-photosensitive source of reducible silver ions that includes silver benzotriazole, a reducing agent composition for said non-photosensitive source reducible silver ions comprising an ascorbic acid, and in one or more of said thermally developable imaging layers, one or more of the following compounds present as an antifoggant in an amount of from about 5 to about 25 mmol/mol of total silver:

(BZ-1)

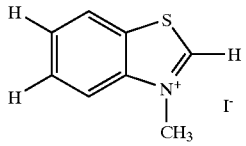

(BZ-4)

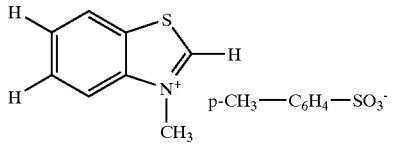

(BZ-5)

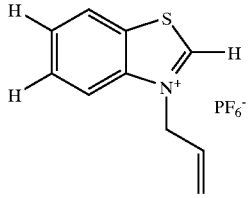

(BZ-6)

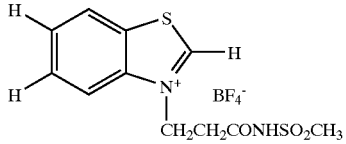

(BZ-7)

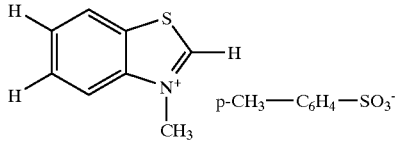

(BZ-8)

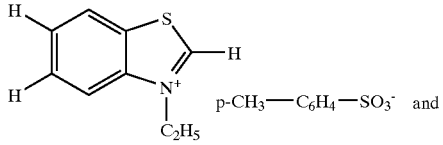

(BZ-9)

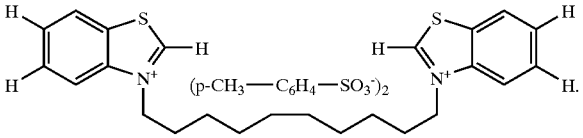

23. A method of forming a visible image comprising:

A) imagewise exposing the photothermographic material of claim 1 to electromagnetic radiation to form a latent image, B) simultaneously or sequentially, heating said exposed photothermographic material to develop said latent image into a visible image.

24. The method of claim 23 wherein said photothermographic material comprises a transparent support, and said image-forming method further comprises:

C) positioning said exposed and heat-developed photothermographic material with the visible image thereon between a source of imaging radiation and an imageable material that is sensitive to said imaging radiation, and D) thereafter exposing said imageable material to said imaging radiation through the visible image in said exposed and heat-developed photothermographic material to provide an image in said imageable material.

25. The method of claim 23 wherein said imagewise exposing is carried out using visible or X-radiation.

26. A method of forming a visible image comprising:

A) imagewise exposing the photothermographic material of claim 1 to X-radiation to generate a latent image, and B) simultaneously or sequentially, heating the exposed photothermographic material to develop the latent image into a visible image.

27. An imaging assembly comprising the photothermographic material of claim 1 that is arranged in association with one or more phosphor intensifying screens.

28. An imaging assembly comprising the photothermographic material of claim 23 that is arranged in association with one or more phosphor intensifying screens.

29. The method of claim 23 where said visible image is used for medical diagnosis.

* * * * *